US008534343B2

(12) United States Patent
Yl

(10) Patent No.: US 8,534,343 B2
(45) Date of Patent: Sep. 17, 2013

(54) SECURITY WINDOW

(76) Inventor: Na Hyong Yl, Paju-si (KR)

( * ) Notice: Subject to any disclaimer, the term of this patent is extended or adjusted under 35 U.S.C. 154(b) by 590 days.

(21) Appl. No.: 12/764,443

(22) Filed: Apr. 21, 2010

(65) Prior Publication Data

US 2011/0258932 A1 Oct. 27, 2011

(51) Int. Cl.
*E06B 3/32* (2006.01)

(52) U.S. Cl.
USPC ..... 160/102; 160/136; 160/159; 160/152; 160/107

(58) Field of Classification Search
USPC ..... 160/107, 290.1, 136, 159, 152, 102, 160/103, 104, 99, 100; 49/69, 72, 54
See application file for complete search history.

(56) References Cited

U.S. PATENT DOCUMENTS

| | | | | |
|---|---|---|---|---|
| 566,284 | A * | 8/1896 | Casselberry | 160/100 |
| 993,654 | A * | 5/1911 | Conant | 160/102 |
| 1,038,138 | A * | 9/1912 | Hikes | 160/100 |
| 1,908,919 | A * | 5/1933 | Reed | 160/102 |
| 2,422,840 | A * | 6/1947 | Mayer | 160/34 |
| 4,816,310 | A * | 3/1989 | Truyens | 428/12 |
| 2007/0245631 | A1 * | 10/2007 | Yi | 49/55 |
| 2011/0258932 | A1 * | 10/2011 | Yl | 49/54 |

* cited by examiner

*Primary Examiner* — Blair M. Johnson

(57) ABSTRACT

Disclosed herein is a folding security window, in which an end of the security window is mounted to a window sill, the other end of the security window is connected to a window, a height-adjustable movable part is mounted to a vertical pole of the security window, a connecting means for connecting or disconnecting the security window to or from the window is provided, and the folded security window is not exposed to the outside. When the window is opened or closed, the security window is unfolded or folded, so that the security window does not spoil the appearance of the city. The movable parts mounted to upper and lower ends of the vertical pole enhance the adaptability and movability of the security window. The security window efficiently performs its original function without hindering ventilation, views, or light admittance.

5 Claims, 23 Drawing Sheets

SECURITY WINDOW

BACKGROUND OF THE INVENTION

1. Technical Field

The present invention relates, in general, to a folding security window installed on a sliding window frame and, more particularly, to a folding security window capable of easily being locked and unlocked, which is constructed so that height-adjustable movable parts are inserted into upper and lower ends of vertical poles of the security window, and links connecting spaced vertical poles to each other are received in the vertical poles when the security window is folded, and the security window is easily connected to and disconnected from a general window, thus allowing the security window to be rapidly detached from the general window when a disaster or an emergency occurs or the security window is not in use.

2. Description of the Related Art

Generally, many windows are mounted to outer walls of houses, apartments, shopping centers, and multi-use buildings, and function to replenish indoor air, in addition to providing a view and admitting light.

Among various types of windows, a sliding window is most widely used. The sliding window is designed such that a pair of panes is inserted into a rectangular frame, and a locking unit is mounted to opposing ends of the panes.

The window may be used as a passage for coupling the interior of a room to the exterior thereof. In the summer season, especially the hot season, the window is opened. However, in this case, a stranger may easily break into a house through the window, so theft and robbery are somewhat common.

Recently, because theft using windows is common, an additional security window is usually mounted to the window. A folding security window and a fixed net-type security window are widely used as the security window. The folding security window includes a plurality of vertical poles and links. The net-type security window is designed such that bent pipes are continuously connected to cross each other.

However, the conventional security windows are problematic in that they are directly mounted to the front of a window sill, thus marring the appearance of houses and cities. Further, the conventional security windows have a complex structure, so that it is difficult to ensure an outside view, and ventilating efficiency is low. Particularly, since the conventional security windows are directly mounted to a window sill, people cannot rapidly evacuate a room due to the fixed security window when they must escape through the window in the case of an emergency, such as a fire. Thereby, the conventional security windows may harm people.

SUMMARY OF THE INVENTION

Accordingly, the present invention has been made keeping in mind the above problems occurring in the prior art, and an object of the present invention is to provide a folding security window, which is constructed so that the folding security window is not always mounted to the front of a window, unlike the prior art, but an end of the folding security window is mounted to a window sill, the other end of the security window is connected to the window, a height-adjustable movable part is mounted to a vertical pole of the security window, a connecting means for connecting or disconnecting the security window to or from the window is provided, and the folded security window is not exposed to the outside.

When the window is opened or closed, the security window is unfolded or folded, so that the security window does not spoil the appearance of a structure or the city. The movable parts mounted to upper and lower ends of the vertical pole enhance the adaptability and movability of the security window. Since the security window is easily connected to or disconnected from the window, it is possible to rapidly detach the security window from the window when necessary, so that it is very convenient to use.

Therefore, the present invention provides a folding security window capable of easily being locked or unlocked, which efficiently performs its original function without hindering ventilation, views, or light admittance.

As described above, the present invention provides a folding security window capable of easily being locked and unlocked, which is constructed so that, when a window is opened or closed, the security window is unfolded or folded, so that the security window does not spoil the appearance of a structure or the city. Movable parts mounted to upper and lower ends of the vertical pole enhance the adaptability and movability of the security window. Since the security window is easily connected to or disconnected from the window, it is possible to rapidly detach the security window from the window when necessary, so that it is very convenient to use.

Further, the present invention provides a folding security window capable of easily being locked or unlocked, which efficiently performs its original function without hindering ventilation, views, or light admittance.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF SPECIFIC EMBODIMENTS

Preferred embodiments of the present invention will be described in detail with reference to the accompanying drawings.

Preferred embodiments of the present invention will be described in detail with reference to the accompanying drawings.

Figure 1:
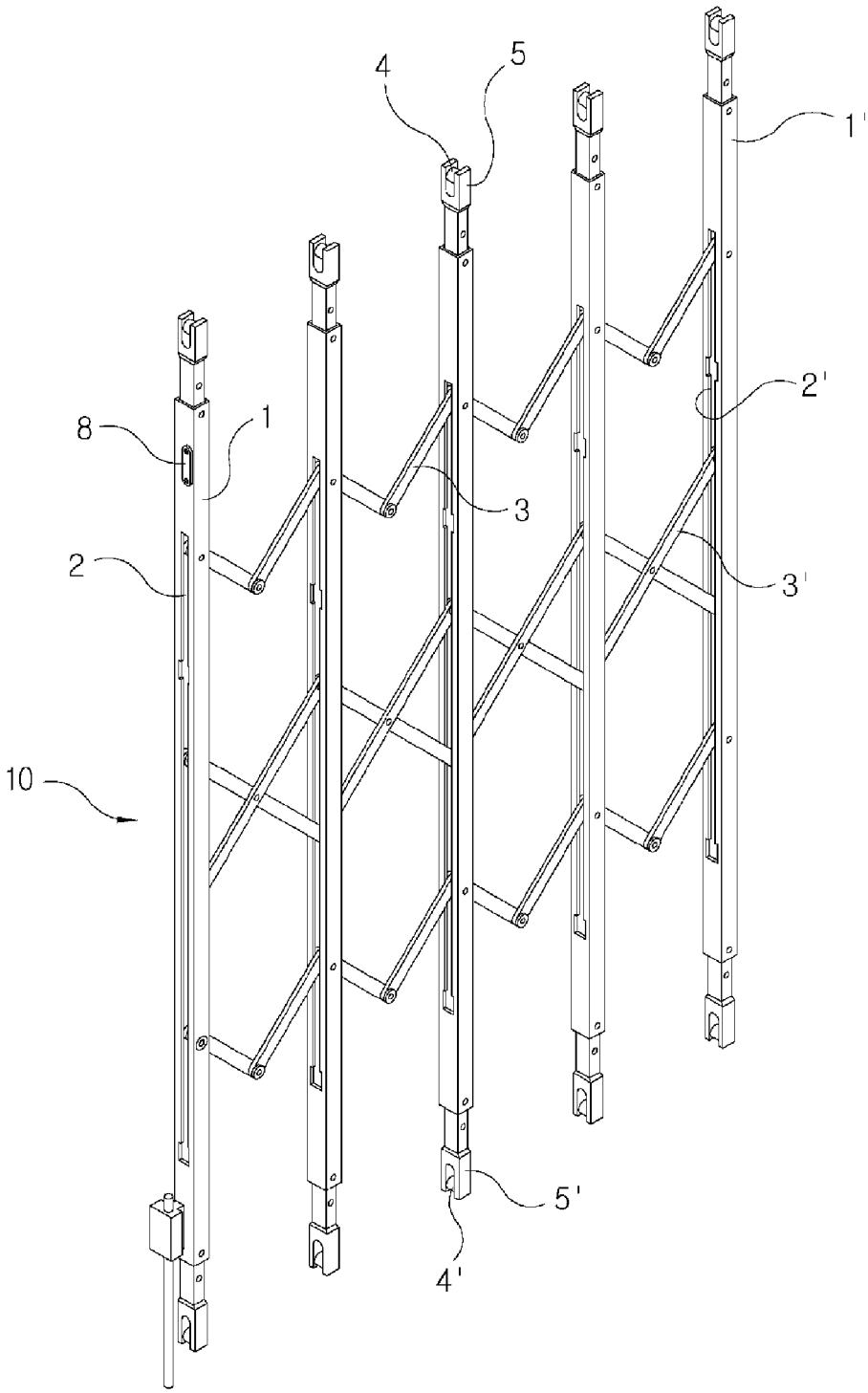
FIG. 1 is a perspective view of a security window, according to the present invention.
Figure 2:
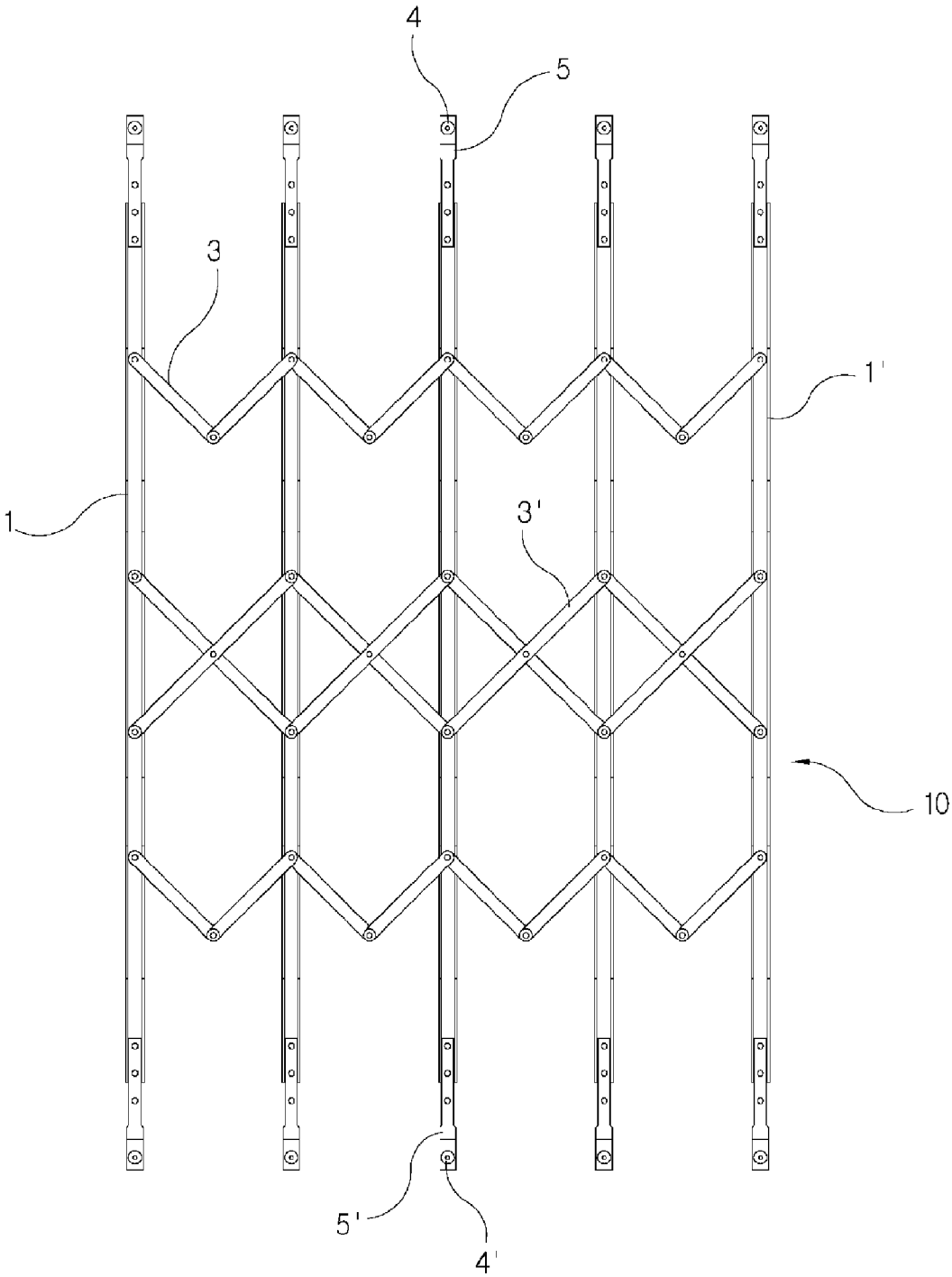
FIG. 2 is a sectional view of the security window, according to the present invention, when the security window is unfolded.
Figure 3:
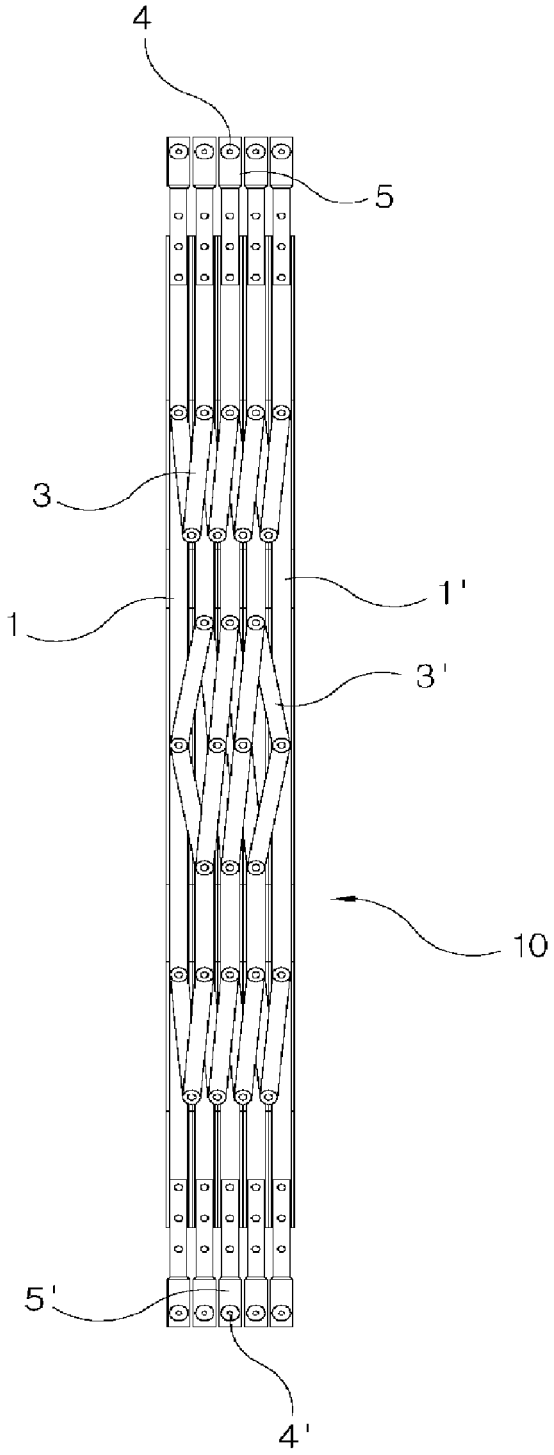
FIG. 3 is a sectional view of the security window, according to the present invention, when the security window is folded.
Figure 4:
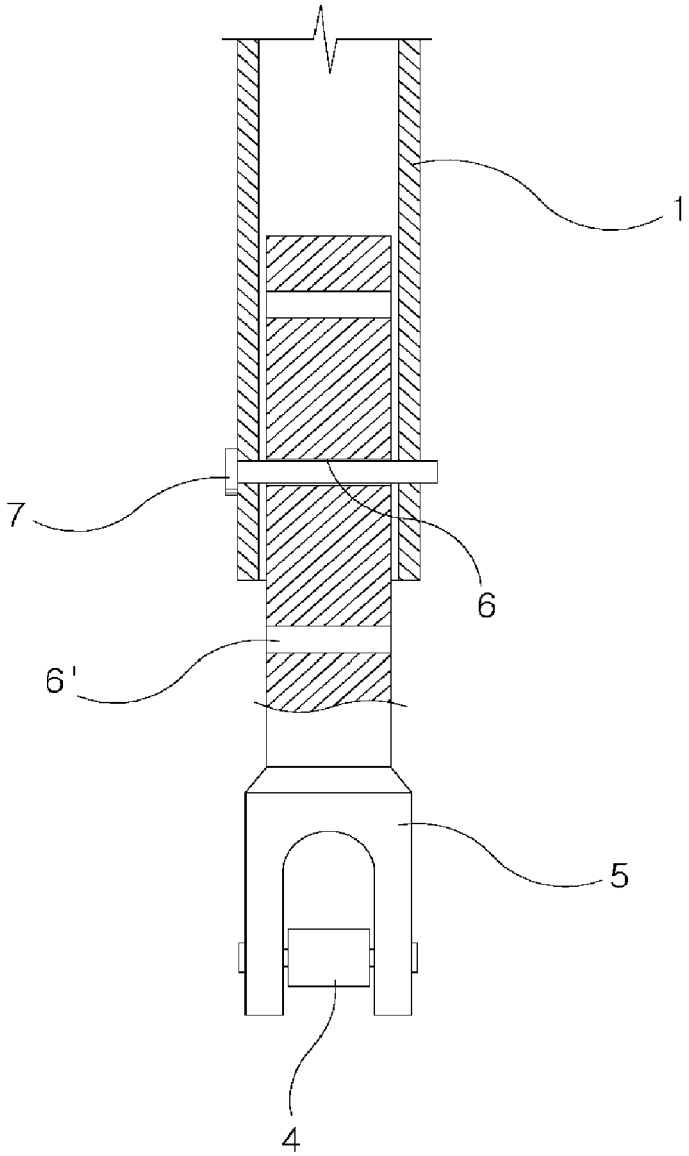
FIG. 4 is an enlarged sectional view to show the lower portion of a vertical pole of the security window, according to the present invention.
Figure 5:
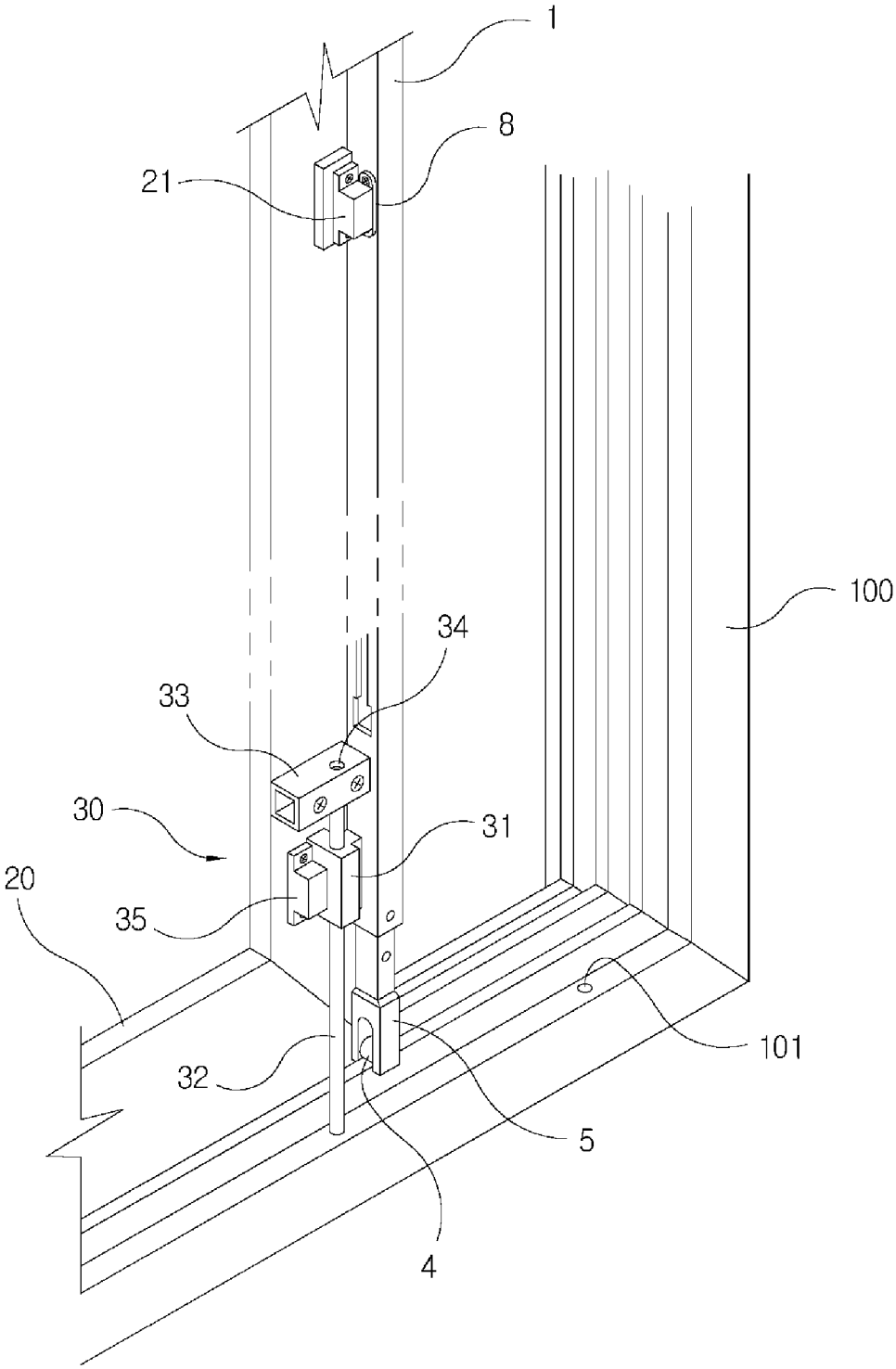
FIG. 5 is a perspective view to show an important part of a connecting unit of the security window, according to the present invention.

FIG. 1 is a perspective view of a security window, according to the present invention, FIG. 2 is a sectional view of the security window, according to the present invention, when the security window is unfolded, FIG. 3 is a sectional view of the security window, according to the present invention, when the security window is folded, FIG. 4 is an enlarged sectional view to show the lower portion of a vertical pole of the security window, according to the present invention, and FIG. 5 is a perspective view to show an important part of a connecting unit of the security window, according to the present invention.

A known folding security window 10 includes a plurality of vertical poles 1 and 1', and a plurality of links 3 and 3' which connect the vertical poles 1 and 1' to each other.

Each of the vertical poles 1 and 1' has the shape of a rectangular pipe. Slots 2 and 2' are formed in both surfaces of each vertical pole 1, 1' having the shape of the rectangular pipe. The links 3 and 3' are inserted into the vertical poles 1 and 1' through the slots 2 and 2'.

Movable parts 5 and 5' having moving rollers 4 and 4' are inserted into the upper and lower ends of the vertical poles 1 and 1'. A plurality of support holes 6 and 6' is formed in the movable parts 5 and 5'. The movable part 5, 5' is secured to the vertical pole 1, 1' by inserting a support pin 7 into an associated support hole 6, 6'.

A metal piece 8 is provided on an upper portion of the vertical pole 1, which is located at one end of the security window. The metal piece 8 is attached to a corresponding connecting magnet 21 which is attached to a window frame 20. A connecting unit 30 is provided on a lower portion of the vertical pole 1 to connect or disconnect the security window to or from the window frame 20.

The vertical pole 1', which is located at the other end of the security window, is secured to an inner surface of a window sill 100. Thus, as the window frame 20 is opened or closed, the security window 10 is unfolded or folded.

Further, according to another example of a moving and height-adjusting means for the vertical poles 1 and 1', moving bars 42 and 42' are provided on upper and lower portions of the vertical poles 1 and 1' and are spaced apart from each other. The upper and lower ends of the vertical poles 1 and 1' are inserted into the moving bars 42 and 42'.

A support body 40 having an insertion hole 41 is provided on an upper end of the vertical pole 1, 1', so that the moving bar 42 is inserted into the insertion hole 41.

Another insertion hole 41' is formed in the lower end of each of the vertical poles 1 and 1', so that another moving bar 42' is inserted into the insertion hole 41'. Thus, the vertical poles 1 and 1' can be easily unfolded or folded along the moving bars 42 and 42'. The support body 40 inserted into the upper end of each of the vertical poles 1 and 1' may be freely moved up and down. Thus, by adjusting the height at which the upper moving bar 42 is secured, the height of the security window can be adjusted.

Brackets 43 and 43' are provided on ends of the moving bars 42 and 42' to be mounted to the window sill 100. Thus, the security window is mounted to the window sill 100 using the brackets 43 and 43'.

The connecting unit 30 includes a support part 31 provided at a predetermined position on the lower end of the vertical bar 1. A support bar 32 is inserted into the support part 31 in such a way as to be movable up and down. A seating hole 101 is formed at a predetermined position in the window sill 100. Further, a connecting part 33 is provided on the lower portion of the window frame 20, and has a connecting hole 34 so that the upper end of the support bar 32 is inserted into the connecting hole 34 of the connecting part 33.

A support magnet 35 secured to the window frame 20 is provided at a predetermined position on the support part 31. Thus, as the support bar 32 moves up and down, the support part is connected to or disconnected from the connecting part 33. Thereby, the security window is connected to or disconnected from a window.

The construction of a connecting unit according to another embodiment of the present invention will be described below. A connecting part 33 having a connecting hole 34 protrudes from the lower portion of the vertical pole 1 which is located at one end of the security window. A conventional locking unit 37 having a rotary elevating part 36 is mounted to the lower portion of the window frame 20. Thus, as the rotary elevating part 36 moves up and down, the locking unit is connected to or disconnected from the connecting part 33. Thereby, the security window is connected to or disconnected from the window.

Further, an additional connecting pole 39 having a plurality of rotary hooks 38 may be mounted to one end of the window frame 20. Hook holes 38' are formed in the vertical pole 1 at positions corresponding to the rotary hooks 38. Thus, by adjusting the rotary hooks 38, the security window is connected to or disconnected from the window.

The security window 10 may be directly installed in the window sill 100 so that the vertical poles 1 and 1' provided on both ends of the security window 10 are directly secured to the window frame 20 and the window sill 100. In such a state, the security window 10 is folded or unfolded.

Further, an additional security window frame 22 may be formed. In this case, a vertical pole 1' provided on one end of the security window 10 is secured in the security window frame 22. In such a state, the security window frame 22 is mounted to one end of the window sill 100. A vertical pole 1 provided on the other end of the security window 10 installed in the security window frame 22 is detachably connected to one end of the window frame 20 using the connecting unit 30.

The operation of the folding security window capable of easily being locked and unlocked, according to the present invention, will be described in detail with reference to the accompanying drawings.

As shown in the drawings, the security window of this invention includes a plurality of vertical poles 1 and 1', and a plurality of folding links 3 and 3' which connect the vertical poles 1 and 1' to each other. As the vertical poles 1 and 1' are spaced apart from each other, the links 3 and 3' unfold, so that the security window is opened. Conversely, when the vertical poles 1 and 1' approach each other, the links 3 and 3' are rotated to be vertical, so that the security window 10 folds.

In this case, the vertical pole 1 provided at one end of the security window is directly connected to one end of the window frame 20, and the vertical pole 1' provided at the other end of the security window is secured to the inner surface of the window sill 100. Thereby, the security window 10 unfolds or folds as the window frame 20 is opened or closed.

Unlike the prior art, the security window is not secured to the entire surface of the window frame, and is unfolded when the window is opened.

Particularly, when the security window 10 is folded, the links 3 and 3' are not exposed to the outside, but are completely inserted into the vertical poles 1 and 1' so that they are not observed from the exterior. Each of the vertical poles 1 and 1' has the shape of a rectangular pipe. The slots 2 and 2' are formed in both sides of each vertical pole 1, 1' having the shape of the rectangular pipe, and ends of the links 3 and 3' are inserted into the vertical poles 1 and 1' through the slots 2 and 2'. That is, the links 3 and 3' are rotated and folded to be inserted into the vertical poles 1 and 1'.

Since the security window must be frequently unfolded or folded when the window is opened or closed, the movable parts 5 and 5' are mounted to the upper and lower ends of the vertical poles 1 and 1', thus allowing the security window to more smoothly move.

The movable parts 5 and 5' have on the lower ends thereof the moving rollers 4 and 4'. Since the moving rollers 4 and 4' rotate and move along a rail (not shown), the sliding motion of the vertical poles 1 and 1' is very easy. The height of each of the moving parts 5 and 5' is adjustable from the end of each of the vertical poles 1 and 1'. Thus, the security window of this invention is easily adapted to various sizes of windows.

A plurality of support holes 6 and 6' is laterally formed in the movable parts 5 and 5' inserted into ends of the vertical poles 1 and 1' each having the shape of the rectangular pipe. By inserting the support pin 7 into an associated support hole, the movable parts 5 and 5' are secured to the vertical poles 1 and 1'. According to the height of the support hole 6, 6' into which the support pin 7 is inserted so as to support the movable part 5, 5', the overall height of the security window 10 is changed. Thus, even if the height of a window is slightly different from a preset height, it is possible to apply the security window 10 to various windows by adjusting the height of the movable part 5, 5' without manufacturing the vertical poles 1 and 1' again.

Further, the vertical pole 1 provided at one end of the security window is secured to one end of the window frame 20, so that the security window folds or unfolds as the window frame 20 is closed or opened. The metal piece 8 is provided on the upper end of the vertical pole 1, and the connecting magnet 21 is provided on the window frame 20 at a position corresponding to the metal piece 8. Thereby, the metal piece 8 is attached to the connecting magnet 21 by an attractive force.

The connecting unit 30 is provided on the lower end of the vertical pole 1 to connect the security window to the window. Thus, as the window frame 20 is opened or closed, the security window 10 is unfolded or folded together with the window frame.

Particularly, when the security window 10 is not in use or people must escape through a window because of an emergency, such as a fire, the security window 10 may be separated from the window frame 20. The separated security window 10 is folded and secured to one side, so that it is possible to completely open the window.

Figure 6:
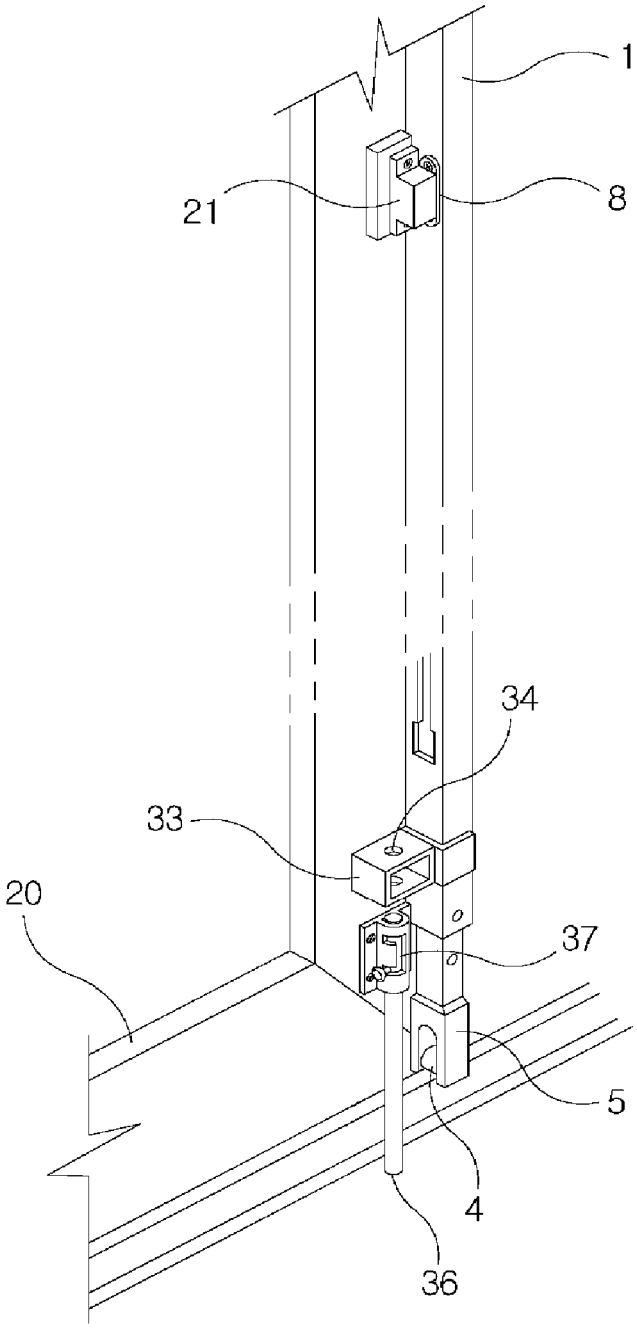
FIG. 6 is a perspective view to show another embodiment of a connecting unit of the security window, according to the present invention.

To this end, the connecting unit 30 is detached from the window. As shown in FIG. 6, the connecting unit 30 includes the support part 31 mounted to one end of the vertical pole 1. The support bar 32 is inserted into the support part 31 in such a way as to move up and down. The connecting part 33 having the connecting hole 34 is provided above the support bar 32, and is secured to the window frame 20. When the support bar 32 moves up to be inserted into the connecting hole 34 of the connecting part 33, the security window 10 is connected to the window frame 20. Conversely, when the support bar 32 moves down to be removed from the connecting hole 34, the security window 10 is separated from the window frame 20.

In this case, the support bar 32 is freely movable up and down without an additional support means. When the support bar 32 moves along the window sill 100, the length of the support bar 32 is adjusted so that the support bar 32 is inserted into the connecting hole 34 of the connecting part 33. Meanwhile, when the support bar 32 moves to one side of the window sill 100 and is positioned in the seating hole 100' formed in the window sill 100, the support bar 32 moves down to be removed from the connecting hole 34. Thereby, the security window 10 is separated from the window frame 20.

Even when the security window 10 is folded, there are cases where the support bar 32 must not move down, in order to maintain connection between the security window and the window. To this end, the support magnet 35 is provided on one side of the support part 31 to be secured to the window frame 20, so that the support magnet 35 supports the support bar 32 using a predetermined attractive force. Thus, only when the support bar 32 moves down, the connecting force of the support bar 32 is released so that the security window 10 is separated from the window frame 20.

The connecting unit 30 may comprise the conventional locking unit 37, as shown in FIG. 6. The conventional locking unit 37 has the rotary elevating part 36 therein. The locking unit 37 is mounted to the window frame 20, and the connecting part 33 having the connecting hole 34 is provided above the rotary elevating part 36 and is secured to one side of the vertical pole 1. Thereby, when the rotary elevating part 36 is forced to move up, the rotary elevating part 36 is connected to the connecting part 33, so that the security window 10 is connected to the window frame 20. Conversely, when the rotary elevating part 36 moves down, the security window 10 is separated from the window frame 20.

Figure 10:
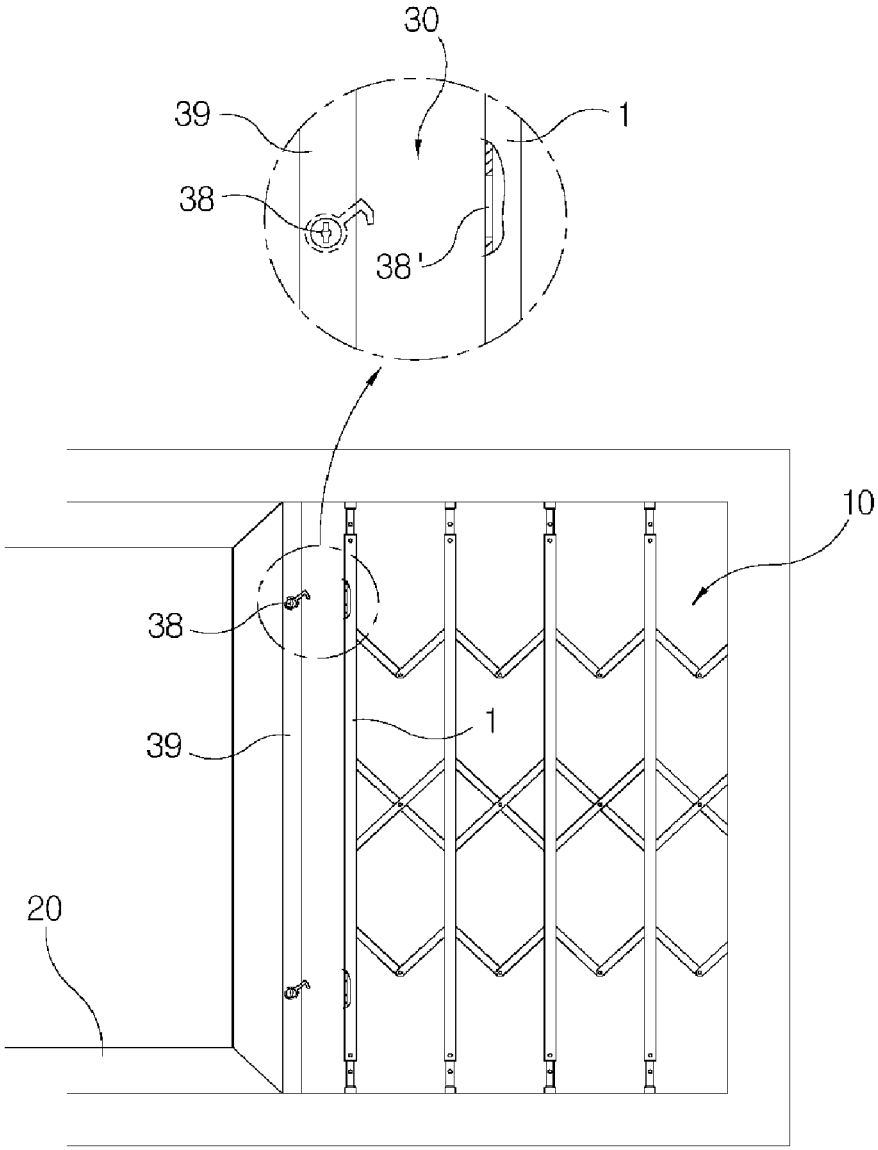
FIG. 10 is a view to show a further embodiment of a connecting unit for connecting the window to the security window, according to the present invention.

Further, the connecting unit 30 may be provided on the additional connecting pole 39, as shown in FIG. 10. A plurality of rotary hooks 38 protrudes from the connecting pole 39, and a plurality of hook holes 38' is formed in the vertical pole 1 at positions corresponding to the rotary hooks 38. When the rotary hooks 38 of the connecting pole 39 rotate to be inserted into the hook holes 38' of the vertical pole 1, the security window 10 is connected to the window frame 20. Meanwhile, when the rotary hooks 38 rotate upward to be removed from the hook holes 38', the security window 10 is removed from the window frame 20.

Figure 7:
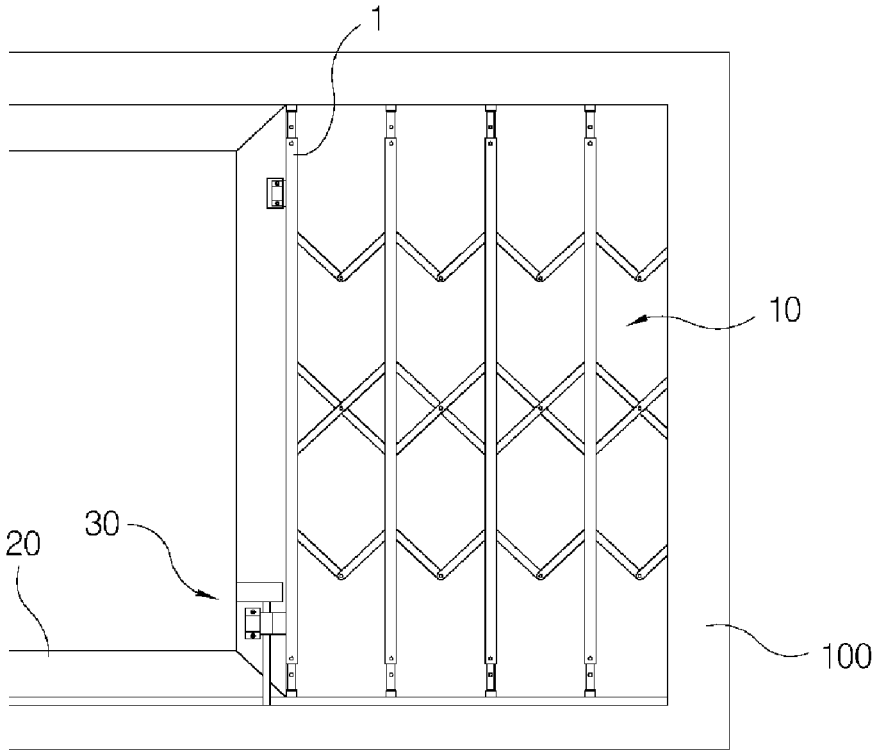
FIG. 7 is a view to show the state where a window is connected to the security window of this invention and is open.
Figure 8:
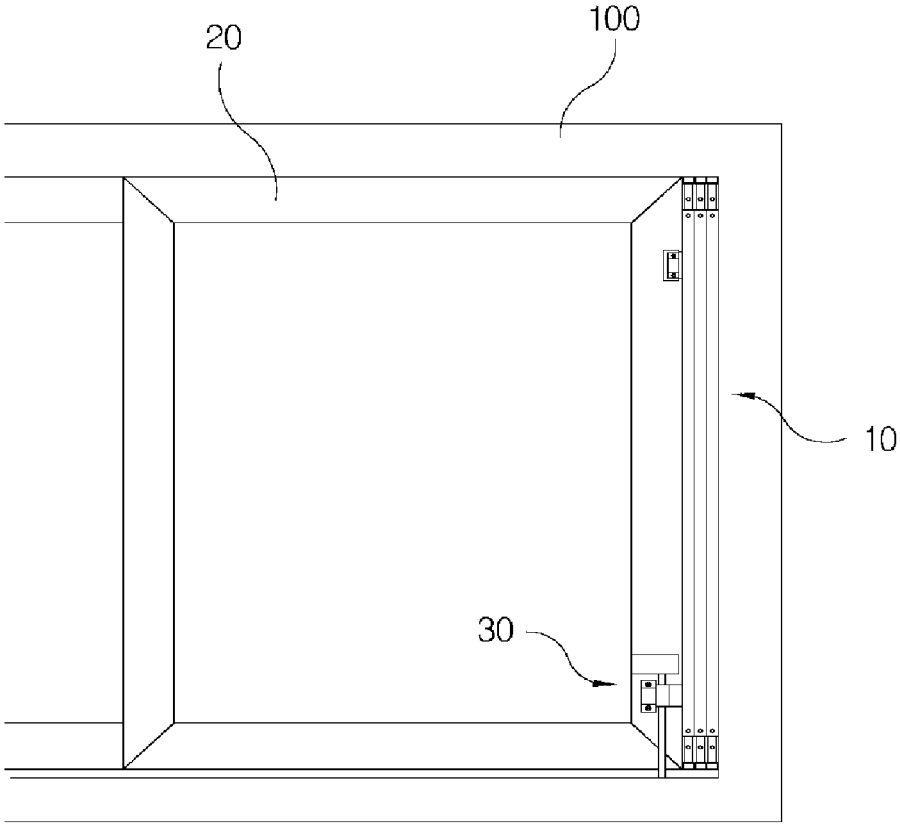
FIG. 8 is a view to show the state where the window is connected to the security window of this invention and is closed.
Figure 9:
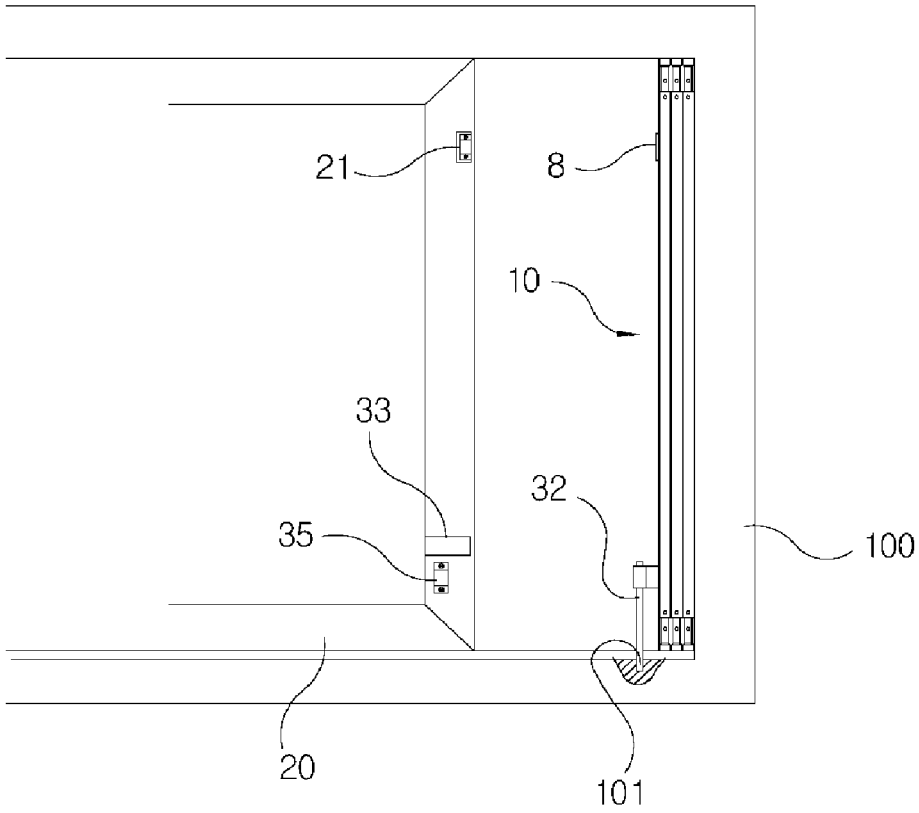
FIG. 9 is a view to show the state where the window is disconnected from the security window of this invention and is open.

The operation of the security window according to the present invention will be described with reference to FIGS. 7 to 9. When the security window 10 is connected to the window frame 20, the security window 10 is unfolded or folded as the window is opened or closed, as shown in FIG. 7. When the connecting unit 30 of FIG. 8 is released and thereafter the window is opened, the security window 10 maintains a folding state and only the window is opened, as shown in FIG. 9. Thus, it is more convenient to use the security window.

Particularly, a storage recess (not shown) may be formed in one side of the window frame 20 to receive the folded security window 10. In this case, the folded security window 10 is not exposed to the outside, thus providing a good appearance without affecting the original functions of the window, such as ventilation, a view, or light admittance.

Figure 11:
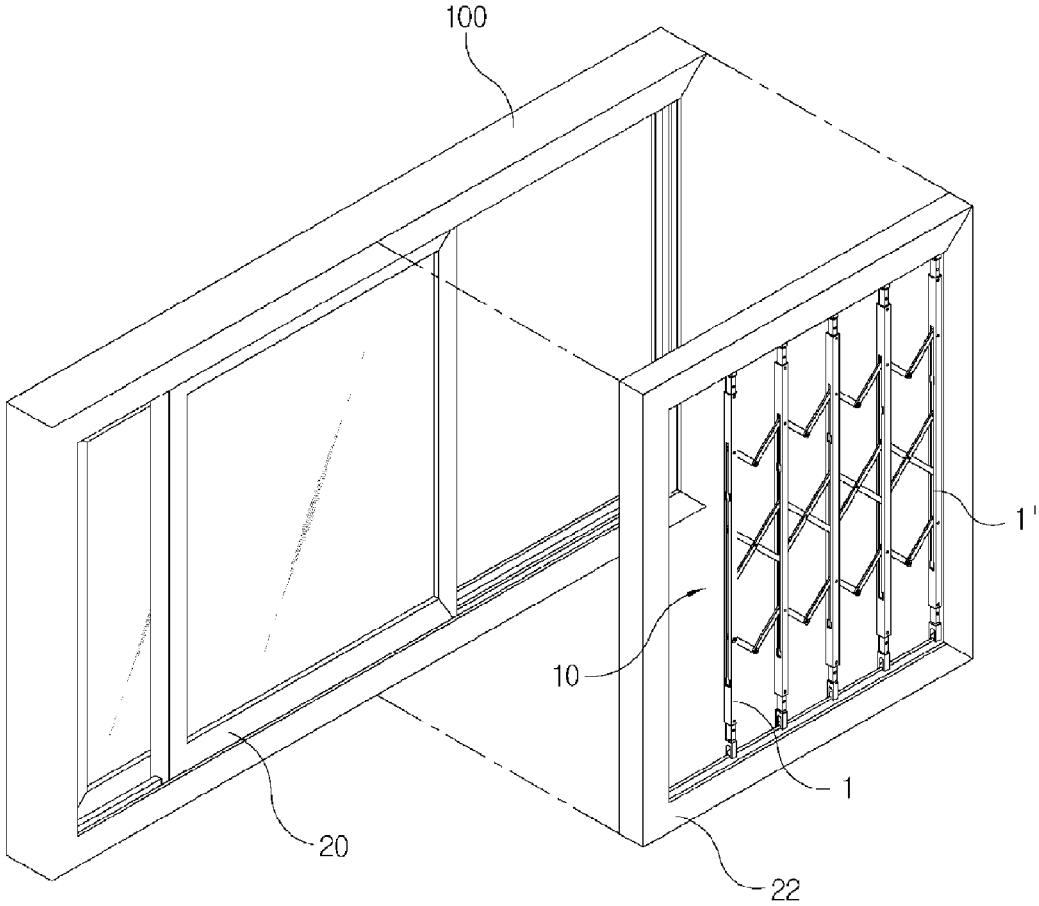
FIG. 11 is a perspective view to show the state where the security window of this invention is installed in an additional frame and mounted to a window sill.

Further, as shown in FIG. 11, the additional rectangular security window frame 22 may be formed. After one vertical pole 1' of the security window 10 is secured to one end of the rectangular security window frame 22, the security window frame 22 is mounted to the window sill 100 which has been already installed, and another vertical pole 1 is connected to the window frame 20. Such a construction allows the security window 10 to be more easily installed, and allows the window to be completely closed when the security window 10 is separated from the window frame 20.

Figure 12:
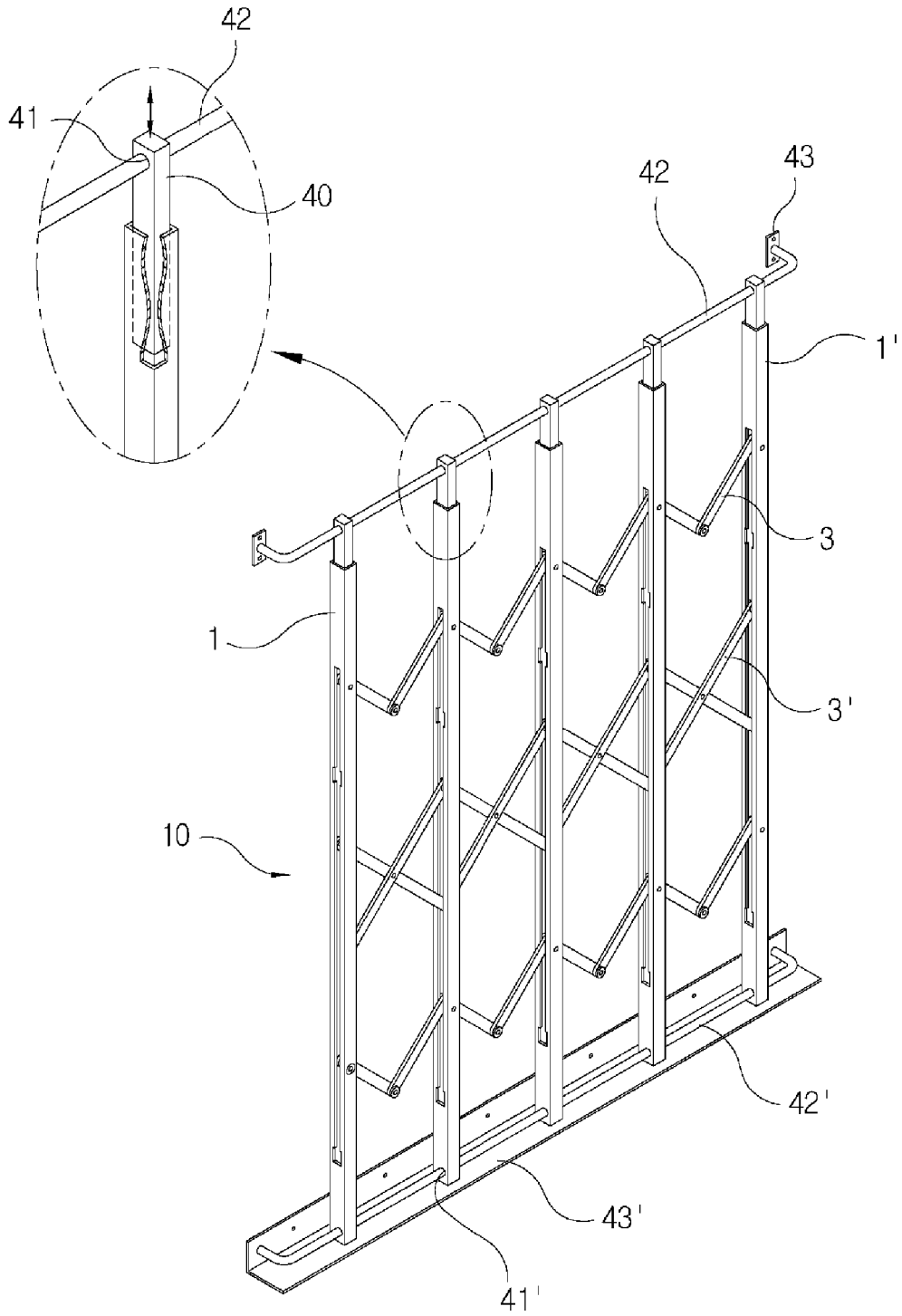
FIG. 12 is a view to show another embodiment of a security window, according to the present invention.

Further, as shown in FIG. 12, the moving bars 42 and 42' are provided on the upper and lower ends of the vertical poles 1 and 1' of the security window 10 in such a way as to be spaced apart from each other. The upper and lower ends of the vertical poles 1 and 1' are inserted into the moving bars 42 and 42'.

In this case, the movable support body 40 is inserted into the upper end of each of the vertical poles 1 and 1'. When the moving bar 42 is inserted into the insertion holes 41 in the support bodies 40, the support bodies 40 inserted into the vertical poles 1 are simultaneously extended from or retracted into the vertical poles by the vertical motion of the moving bar 42. In this way, the overall height of the security window 10 is adjustable.

Another insertion hole 41' is directly formed in the lower end of each of the vertical poles 1 and 1'. Thus, when the moving bar 42' disposed at a lower position is inserted into the insertion holes 41', the vertical poles 1 and 1' are easily unfolded or folded along the moving bar 42'.

Such a security window 10 is mounted to a side surface of the window sill 100 using the brackets 43 and 43' provided at ends of the moving bars 42 and 42'. Afterwards, one vertical pole 1 is connected to the window frame 20 via the connecting unit 30, as in the above-mentioned embodiments. Another vertical pole 1' is secured to a vertical side surface of the window sill 100. Thus, as the window frame 20 is opened or closed, the security window 10 is easily unfolded or folded.

Therefore, the security window of the present invention is characterized in that it is very efficient, and is universally usable.

Figure 13:
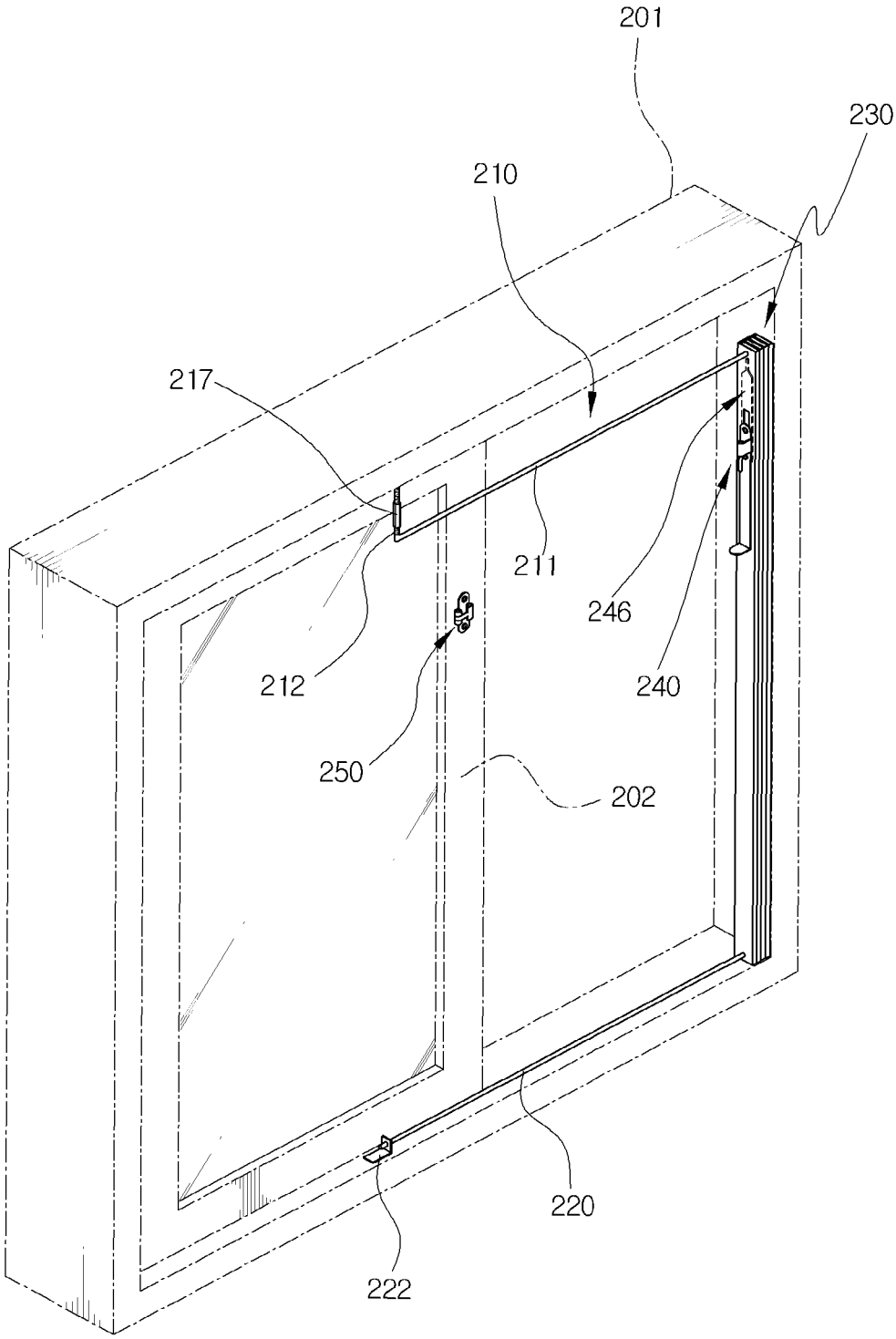
FIG. 13 is a perspective view illustrating a security window according to a preferred embodiment of the present invention.
Figure 18:
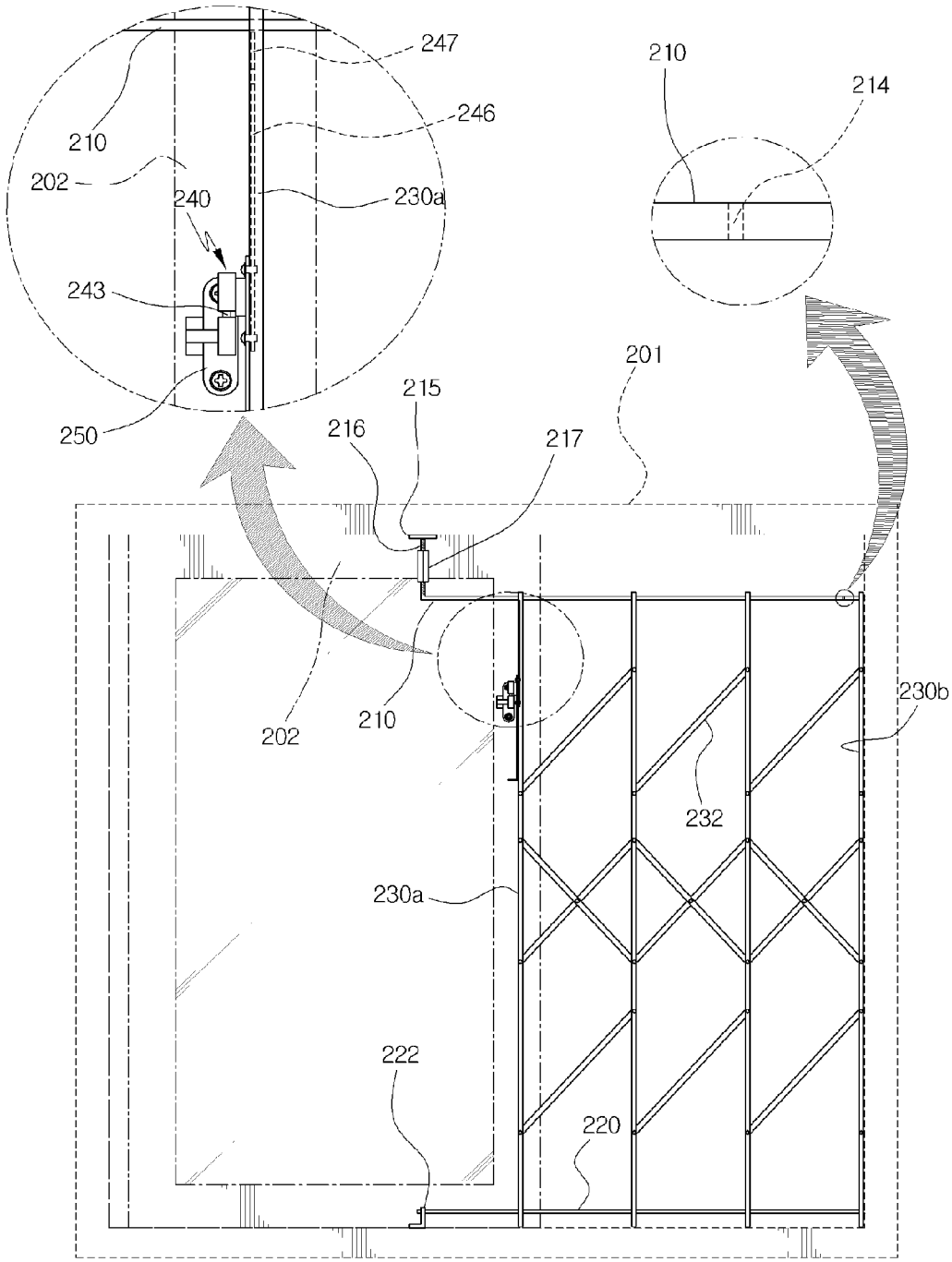
FIG. 18 is a front view illustrating an operation state of the security window when an operable window sash is fully opened.

FIG. 13 is a perspective view illustrating a security window according to a preferred embodiment of the present invention. FIG. 18 is a front view illustrating an operation state of the security window when a window sash is fully opened.

As shown in FIGS. 13 and 18, the security window includes a upper guide rod 210 whose one end is fixed to a head-jamb of the window frame 201, a lower guide rod 220 whose one end is fixed to a sill of the window frame 201, a plurality of vertical rods 230 both ends of which the lower and upper guide rods 210 and 220 extend through, respectively, links 232 for joining the vertical rods 230 to each other, a hook operating member 240 and a hook movement control member 246 installed in one of the vertical rods 230, and a hooking receiving member 250 installed in a stile 202 of the window sash that is operable, i.e., can be opened or closed.

The upper guide rod 210 is configured to include a horizontal body 211 shaped as a relatively long rod and a vertical body 212 formed as one end of the horizontal body 211 is perpendicularly bent with respect to the horizontal body 211. The vertical body 212 forms an external thread on its outer surface. The other end of the horizontal body 211 is fixed to the side-jamb of the window frame 201. The vertical body 212 is joined with a length adjustment external screw member 216, whose outer surface forms an external thread, via a length adjustment internal screw member 217 whose inner wall forms an internal thread. The length adjustment external screw member 216 is screwed into and coupled to a bracket 215 that is fixed to the lower surface of the head-jamb of the window frame 201. The horizontal body 211 also forms a groove 214 for allowing the entry of a hook movement control member 246 at a position near the other end thereof.

The lower guide rod 220 is shaped as a relatively long rod. One end of the lower guide rod 220 is coupled to a fix bracket 222 that is fixed on the surface of the sill of the window frame 201 by screws, and the other end is fixed to the side jamb of the window frame 201. The fix bracket 222 is shaped as the letter 'L'. A through-hole is formed at a position near the upper end portion of the L-shaped fix bracket 222 and allows the entry of the one end of the lower guide rod 220. The one end of the lower guide rod 220 is then coupled to the through hole of the fix bracket 222.

The plurality of vertical rods 230 are each shaped as a rectangular hollow rod. The vertical rods 230 are coupled to each other by links and also adjust their spacing via the same. The vertical rods 230 are arranged parallel to the side-jamb. The vertical rods 230 are coupled to the upper guide rod 210 as their upper end portions allow the entry of the upper guide rod 210. Likewise, the vertical rods 230 are also coupled to the lower guide rod 220 as their lower end portions allow the entry of the lower guide rod 220. It is assumed that one of the vertical rods 230 is farthest from the side-jamb to which the upper and lower rods 210 and 220 are fixed, called the farthest vertical rod **230*a* (or first vertical rod), and another of the vertical rods 230 is closest to the side-jamb, called the closest vertical rod 230*b* (or second vertical rod). The farthest vertical rod 230*a* is coupled with a hook operating member 240 and a hook movement control member 246. The closet vertical rod 230*b* is closest to and fixed on the surface of the side-jamb of the window frame 201 via fixing members (not shown). The closet vertical rod 230*b* forms coupling through-holes (not shown) at both ends thereof to couple with the upper and lower guide rods 210 and 220, respectively. That is, the other end of the horizontal body 211 of the upper guide rod 210 is extended through the coupling through-hole for the upper guide rod 210 and then fixed to the side-jamb of the window frame 201. Likewise, the other end of the lower guide rod 220 is extended through the coupling through-hole for the lower guide rod 220 and then fixed to the side-jamb of the window frame 201**.

In operation, when the farthest vertical rod 230*a* is moved far from the side-jamb of the window frame 201, the remaining vertical rods 230, other than the closest vertical rod 230*b* fixed to the side-jamb of the window frame 201, are moved in the direction of the movement of the farthest vertical rod 230*a*, being spaced with a certain distance from each other via the links 232.

Figure 14:
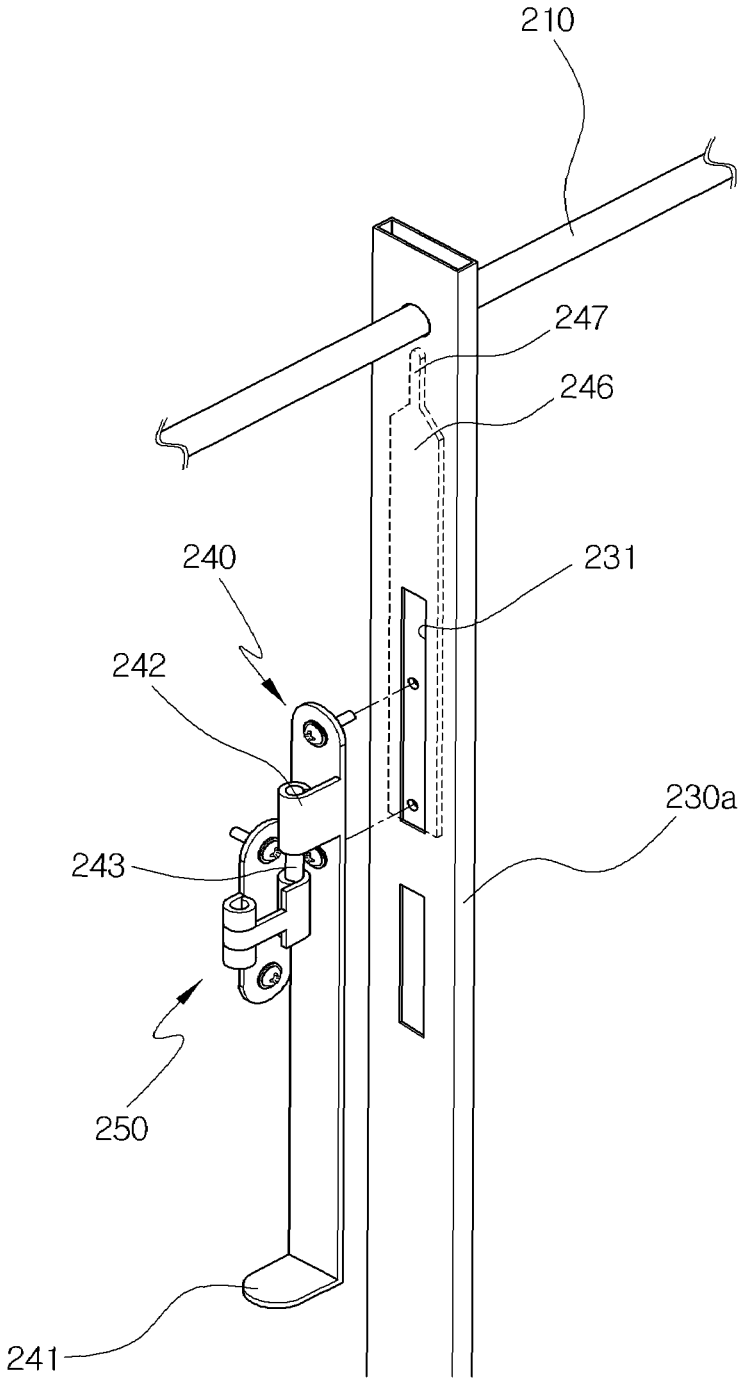
FIG. 14 is a perspective view illustrating a hook operating member, a hook receiving member and peripheral members of a security window according to an embodiment of the present invention.
Figure 15:
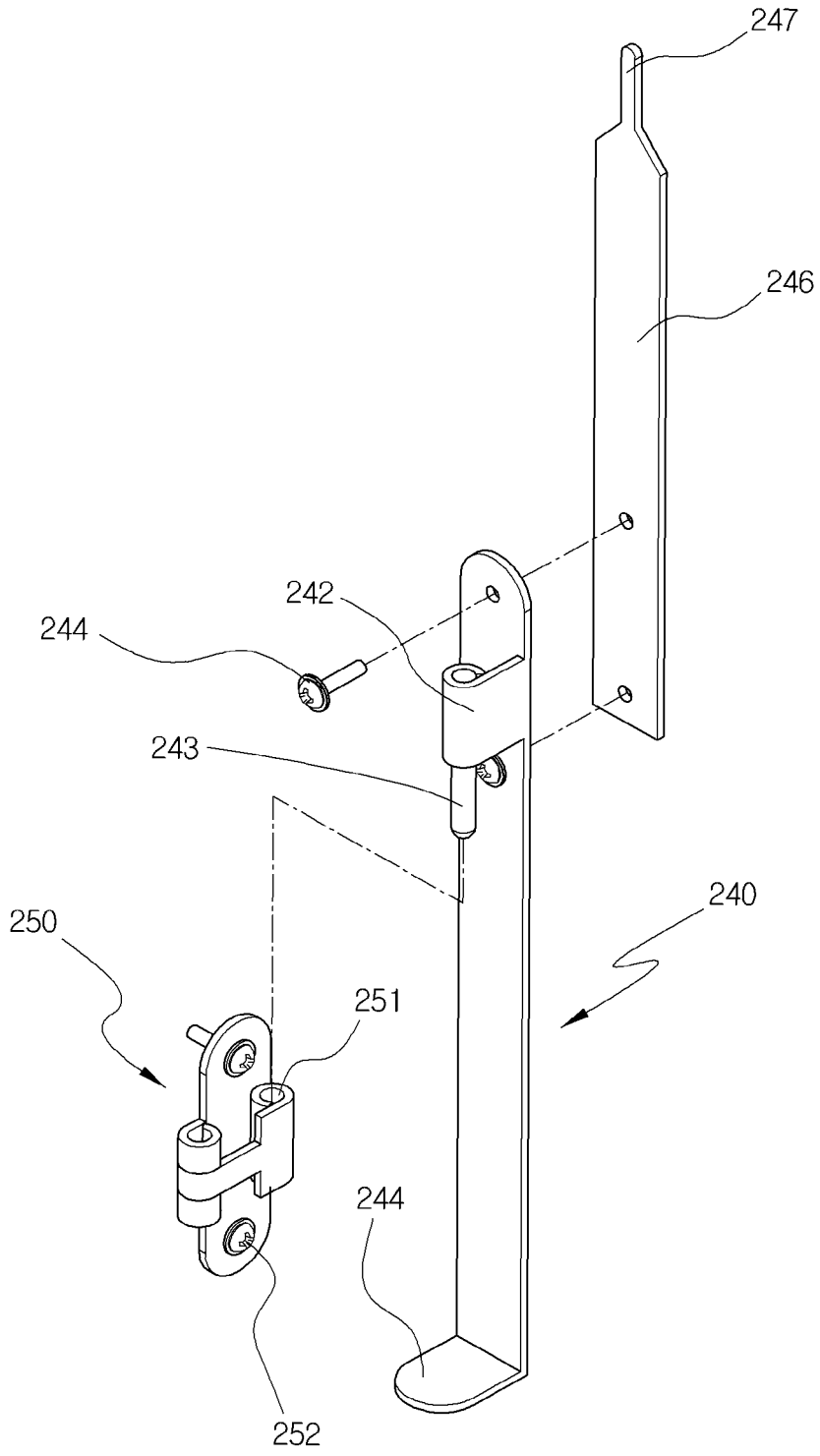
FIG. 15 is an exploded perspective view illustrating a hook operating member and a hook movement control member of a security window according to an embodiment of the present invention.

FIG. 14 is a perspective view illustrating a hook operating member, a hook receiving member and peripheral members of a security window according to an embodiment of the present invention. FIG. 15 is an exploded perspective view illustrating a hook operating member and a hook movement control member of a security window according to an embodiment of the present invention.

As shown in FIGS. 14 and 15, the farthest vertical rod 230*a* forms an opening portion 231 as a certain area is cut out from its side surface. A hook movement control member 246 is placed within the farthest vertical rod 230*a*, exposed through the opening portion 231. The hook movement control member 246 is integrally coupled to a hook operating member 240, placed outside the opening portion 231, via a fixing member 244.

The hook operating member 240 is shaped as a plate whose width is greater than that of the opening portion 231. The hook operating member 240 is formed in such a way that a handle 241 is formed as the lower end portion of the hook operating member 240 is bent and protruded outwardly and a hook fixing part 242 is protruded in the same direction of the handle 241 at the upper portion of the hook operating member 240. The hook fixing part 242 forms a hook 243 shaped as a pin, expended downward from the lower side thereof.

The hook movement control member 246 is shaped as a plate of a certain thickness and inserted into the farthest vertical rod 230*a*. The hook movement control member 246 forms an inserting protrusion 247 at its upper portion, where the inserting protrusion 247 has a relatively narrow width and is inserted into the groove 214.

The hook operating member 240 and the hook movement control member 246 are placed outside and inside the opening portion 231 of the farthest vertical rod 230*a*, respectively, and integrally coupled to each other. Therefore, the hook movement control member 246 is supported by the lower end of the opening portion 231, so that it cannot be moved in the lower direction against the opening portion 231.

The hook receiving member 250 forms a hook receiving through-hole 251 extended through in an upward and downward direction. The hook receiving member 250 is fixed to the stile of an operable window sash via fixing members 252.

In operation, when the farthest vertical rod 230*a* approaches the stile of the window sash, to which the hook receiving member 250 is fixed, in a state where the handle 241 of the hook operating member 240 is lifted up, and then the hook operating member 240 is lowered, the hook 243 of the hook operating member 240 is inserted into the hook receiving through-hole 251 of the hook receiving member 250 and simultaneously the farthest vertical rod 230*a* is coupled to the stile of the window sash to which the hook receiving member 250 is fixed. If the hook operating member 240 is lifted up and then the farthest vertical rod 230*a* is removed from the stile of the window sash to which the hook receiving member 250 is fixed, the farthest vertical rod 230*a* is separated from the stile of the window sash to which the hook receiving member 250 is fixed.

Figure 16:
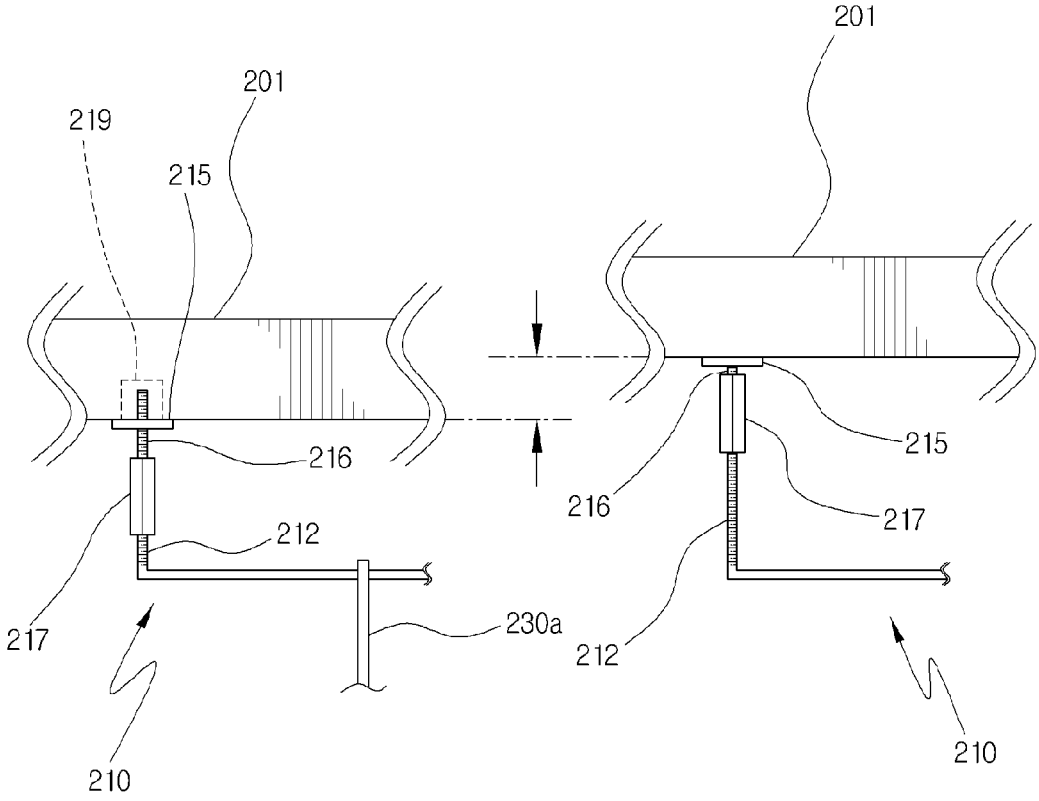
FIG. 16 is a front view illustrating a length adjustment internal screw member of the security window according to an embodiment of the present invention, and its peripheral portion.

FIG. 16 is a front view illustrating a length adjustment internal screw member of the security window according to an embodiment of the present invention, and its peripheral portion.

As shown in FIG. 16, the vertical body 212 of the upper guide rod 210 is coupled to the length adjustment external screw member 216, via the length adjustment internal screw member 217, where the length adjustment external screw member 216 is screwed into the bracket 215 fixed to the head-jamb of the window frame 201. The length adjustment internal screw member 217 is rotated to adjust the distance between the vertical body 212 and the length adjustment external screw member 216. Alternatively, the length adjustment external screw member 216 is rotated with respect to the bracket 215, i.e., screwed out or into the bracket 215, to thereby adjust the distance between the bracket 215 and the vertical body 212. It should be understood that the head-jamb of the window frame 201 may form a hole 219, so that the length adjustment external screw member 216 can be further screwed into the hole 219.

Since the length adjustment internal screw member 217 and the length adjustment external screw member 216 of the security window according to the present invention can adjust the distance between the upper guide rod 210 and the lower surface of the head-jamb, the security window can be installed in the window frames of various heights, where it has the same vertical rods 230. For example, as shown in FIG. 16, if the security window is installed in the window frame of a relatively large height, the length adjustment internal screw member 217 is rotated to increase the distance between the length adjustment external screw member 216 and the vertical body 212 and then the length adjustment external screw member 216 is further rotated to increase the length of the screw member 216 from the bracket 215, thereby increasing the distance between the bracket 215 and the upper guide rod 210. After that, the security window is installed in the large sized window frame. On the contrary, as shown in FIG. 16A, if the security window is installed in the window frame of relatively small height, it can be achieved by performing the reverse processes of adjusting the distance for the relatively large sized window frame.

The length adjustment internal screw member 217 is shaped as a nut consisting of two threaded parts, one with a left-hand thread and the other with a right-hand thread, which is called a turnbuckle. When the length adjustment internal screw member 217 is rotated, the bolts, i.e., the length adjustment external screw member 216 and the vertical body 212, are screwed into or out of the length adjustment internal screw member 217, simultaneously, according to the rotation direction of the length screw member 217, so that the distance between the length adjustment external screw member 216 and the vertical body 212 can be reduced or increased.

Figure 22:
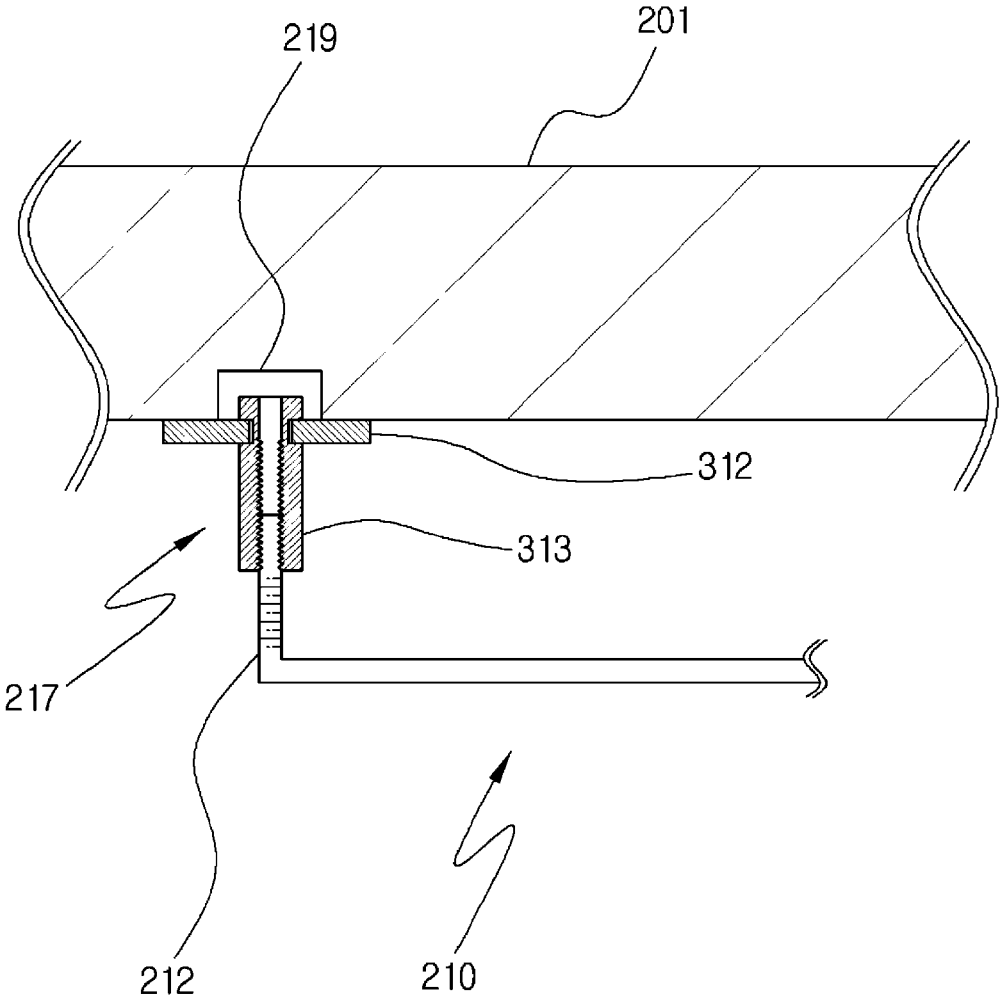
FIG. 22 is a side cross-sectional view another embodiment of a length adjustment internal screw member of the security window according to the present invention.

Alternatively, the length adjustment internal screw member 217 can be modified to a length adjustment member 317 as shown in FIG. 22. That is, the length adjustment 317 is configured to include a nut 313 whose internal wall forms a thread and a bracket 312 coupled to one end of the nut 313 for allowing the nut to be rotated in the initial position. It should be understood that the length adjustment member 317 may be implemented with a pan nut. In use of the length adjustment member 317, the bracket 312 is fixed to a hole formed in the window frame and then the vertical body 212 of the upper guide rod 210 is screwed into the nut 313. After that, when the nut 313 is rotated with respect to the bracket 312, the vertical body 212 is screwed into or out of the nut 313 to thereby adjust the height of the upper guide rod 210.

Although it is not shown in the drawings, the security window according to the present invention can be implemented in such a way that at least one of the upper and lower ends of the vertical rod 230 is configured to be extendable and thus the length of the vertical rod 230 can be properly adjusted according to the size of the window frame 201. For example, the vertical rod 230 can be implemented in such a way that one of its upper and lower ends is collapsible so that its length can be increased or decreased, and an extension bar (not shown) can be inserted into the vertical rod 230 to fix the increased or decreased length of the vertical rod 230.

Figure 17:
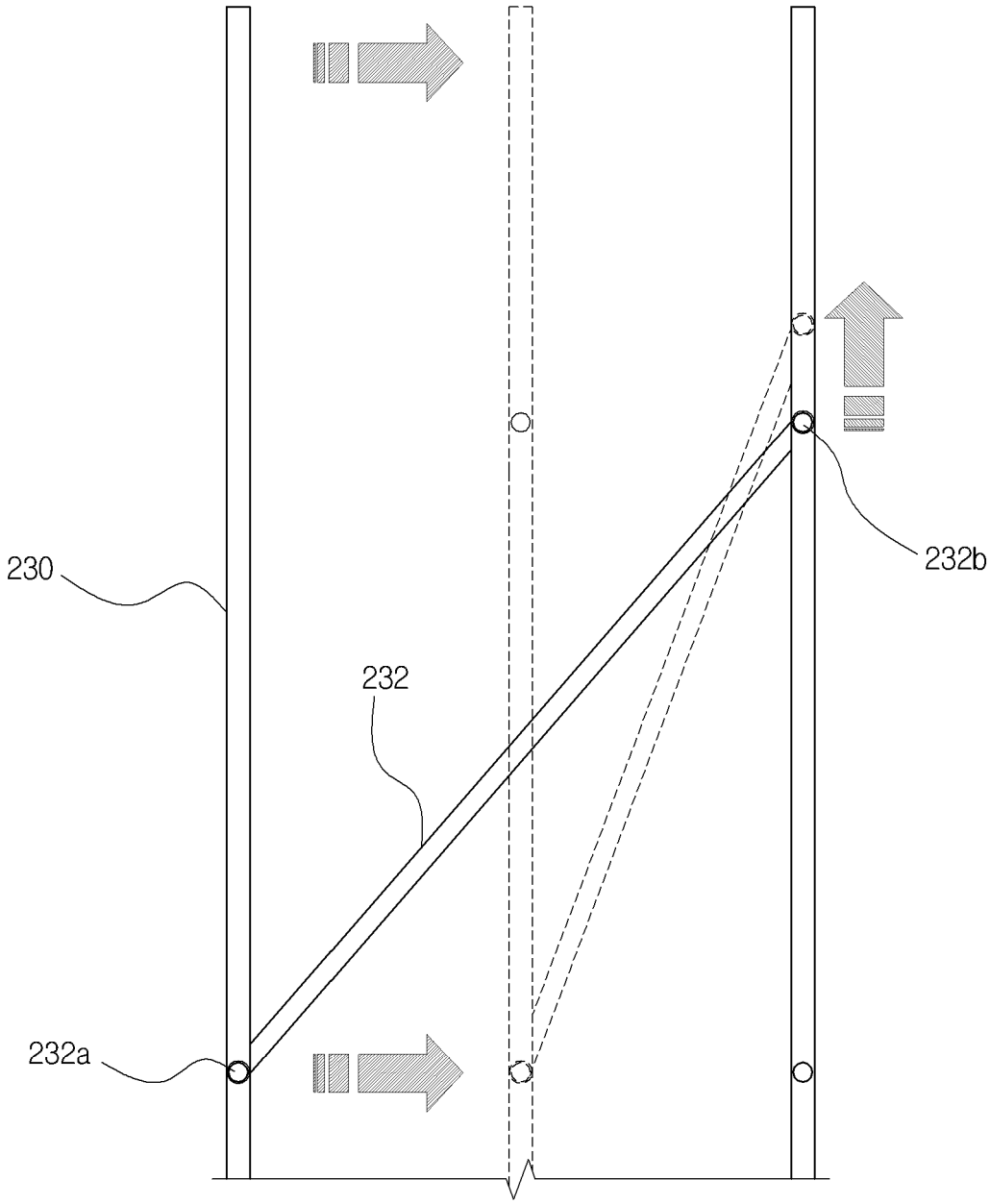
FIG. 17 is a front view that describes the coupling between the vertical rods 30 and the link 32 of the security window according to an embodiment of the present invention.

FIG. 17 is a front view that describes the coupling between the vertical rods 230 and the link 232 of the security window according to an embodiment of the present invention.

A plurality of vertical rods 230 are connected to each other via links 232. For example, as shown in FIG. 17, two vertical rods are connected to each other via a link 232 in such a way that one end 232*a* of the link 232 is pivotally coupled to a position of one vertical rod 230 and the other end 232*b* of the link 232 is slidably connected into another vertical rod adjacent to the vertical rod 230, which is a well known coupling structure.

Figure 19:
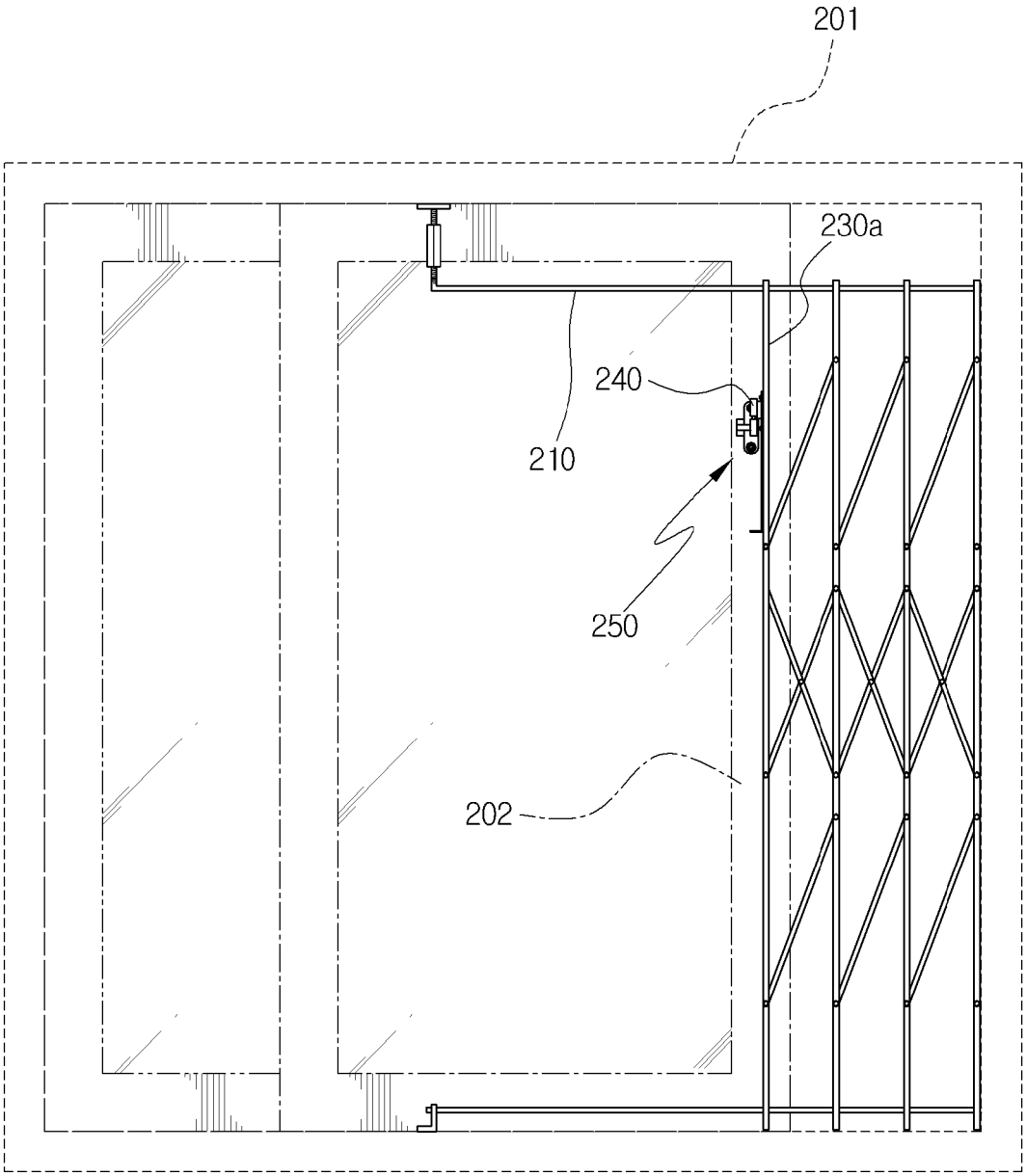
FIG. 19 is a front view illustrating an operation state of the security window when an operable window sash is partially opened.

FIG. 18 is a front view illustrating an operation state of the security window when an operable window sash is fully opened. FIG. 19 is a front view illustrating an operation state of the security window when an operable window sash is partially opened.

As shown in FIG. 18, the farthest vertical rod 230*a* is coupled to the stile 202 of the operable window sash as the hook 243 of the hook operating member 240 is coupled to the hook receiving member 250. When the operable window sash is fully opened, the upper guide rod 210 is across extended through the hollow space above the inserting protrusion 247 of the hook movement control member 246 located in the farthest vertical rod 230*a*. That is, the upper guide rod 210 interrupts the hollow space, so that the hook movement control member 246 cannot be lifted up. In that case, the hook 243 cannot be removed from the hook receiving member 250. Therefore, the farthest vertical rod 230*a* cannot be separated from the stile 202 of the operable window sash, so that the security window cannot be removed from the stile 202.

As shown in FIG. 19, when the operable window sash is partially opened or closed, the upper guide rod 210 is across extended through the hollow space above the inserting protrusion 247 of the hook movement control member 246 located in the farthest vertical rod 230*a*. That is, the upper guide rod 210 still interrupts the hollow space, so that the hook movement control member 246 cannot be lifted up. Therefore, the security window cannot be removed from the stile 202 of the operable window sash.

Figure 20:
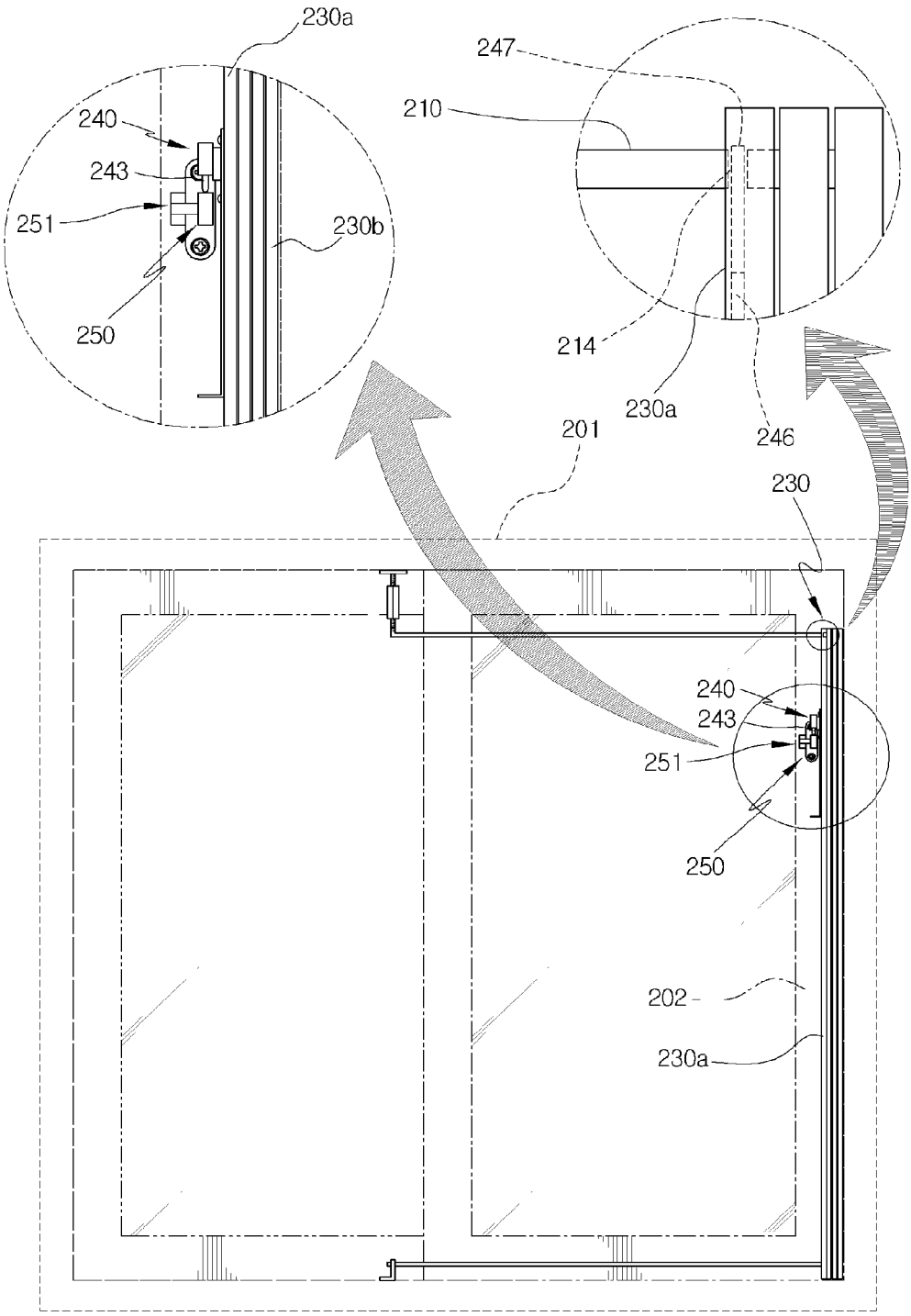
FIG. 20 is a front view describes a state where the hook of the hook operating member is unlocked from the hook receiving member of a security window, according to an embodiment of the present invention, when an operable window sash is fully closed.

FIG. 20 is a front view describes a state where the hook of the hook operating member is unlocked from the hook receiving member of a security window, according to an embodiment of the present invention, when an operable window sash is fully closed.

As shown in FIG. 20, when the operable window sash is fully closed so that a plurality of vertical rods 230 are also fully collapsed, the farthest vertical rod 230*a* is located right beneath the groove 214 of the upper guide rod 210. That is, when the plurality of vertical rods 230 are all collapsed in the direction to close the window sash, the groove 214 is formed so that it can be located right above the position where the farthest vertical rod 230*a* is located.

Since the farthest vertical rod 230*a* is located right beneath the groove 214 of the upper guide rod 210, the inserting protrusion 247 of the hook movement control member 246 within the farthest vertical rod 230*a* can enter the groove 214 of the upper guide rod 210. In this state, when the handle 241 of the hook operating member 240 is lifted up, the hook 243 of the hook operating member 240 is removed from the hook receiving through-hole 251 of the hook receiving member 252. After that, when the operable window sash is moved far from the side-jamb, it is separated from the farthest vertical rod 230*a* of the security window.

As describe above in FIGS. 18 to 20, the security window according to the present invention can be separated from the stile of the window sash only if the window sash is fully closed and simultaneously all the vertical rods 230 are fully collapsed. This means also that the security window cannot be separated from the window sash from the outside as long as this condition is not achieved. That is, the security window can be separated from the window sash only from the inside.

Meanwhile, if the security window is installed in the window sash in a state where the window sash is not fully closed, the farthest vertical rod 230*a* needs to be located right beneath the groove 214 of the upper guide rod 210. This means that installing the security window in the window sash can also be performed only inside the window sash, or indoors.

Figure 21:
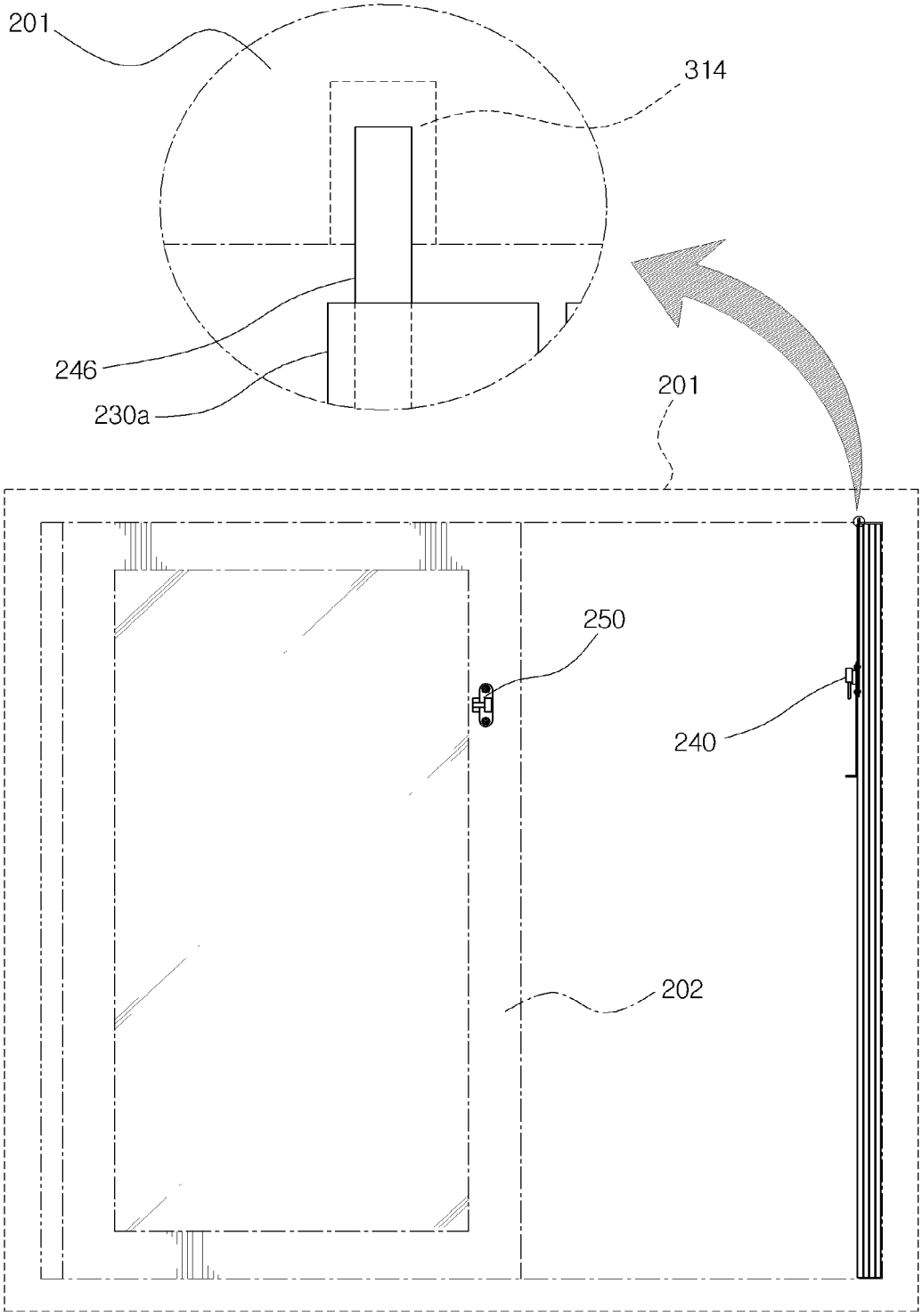
FIG. 21 is a front view describes a state where the hook of the hook operating member is unlocked from the groove of a security window, according to another embodiment of the present invention, when an operable window sash is fully closed.

FIG. 21 is a front view describes a state where the hook of the hook operating member is unlocked from the groove of a security window, according to another embodiment of the present invention, when an operable window sash is fully closed.

As shown in FIG. 21, the security window another embodiment of the present invention is similar to the embodiment shown in FIGS. 13 to 20 in that it includes a hook operating member 240, a hook movement control member 246 and a hook receiving member 250 but differs therefrom in that it does not include upper and lower guide rods. Since another embodiment does not include the upper guide rod, a groove 314 corresponding to the groove 214 of the upper guide rod 210 shown in FIGS. 13 to 20 is formed in the head-jamb of the window frame 201.

In the security window according to another embodiment of the present invention, the vertical rods are moved along the window frame 201 without the use of an additional movement guide member.

Therefore, the hook movement control member 246 is installed in the window frame 201. The window frame 201 also forms a groove 314, so that the hook movement control member 246 can be lifted up into the groove 314.

In that case, the remaining vertical rods, other than the farthest vertical rod 230*a* to which the hook movement control member 246 is installed, may further include a member, so that they can smoothly move along the window frame 201. Example of the member is a roller (not shown), where the roller can be installed at the end of the vertical rod.

Figure 23:
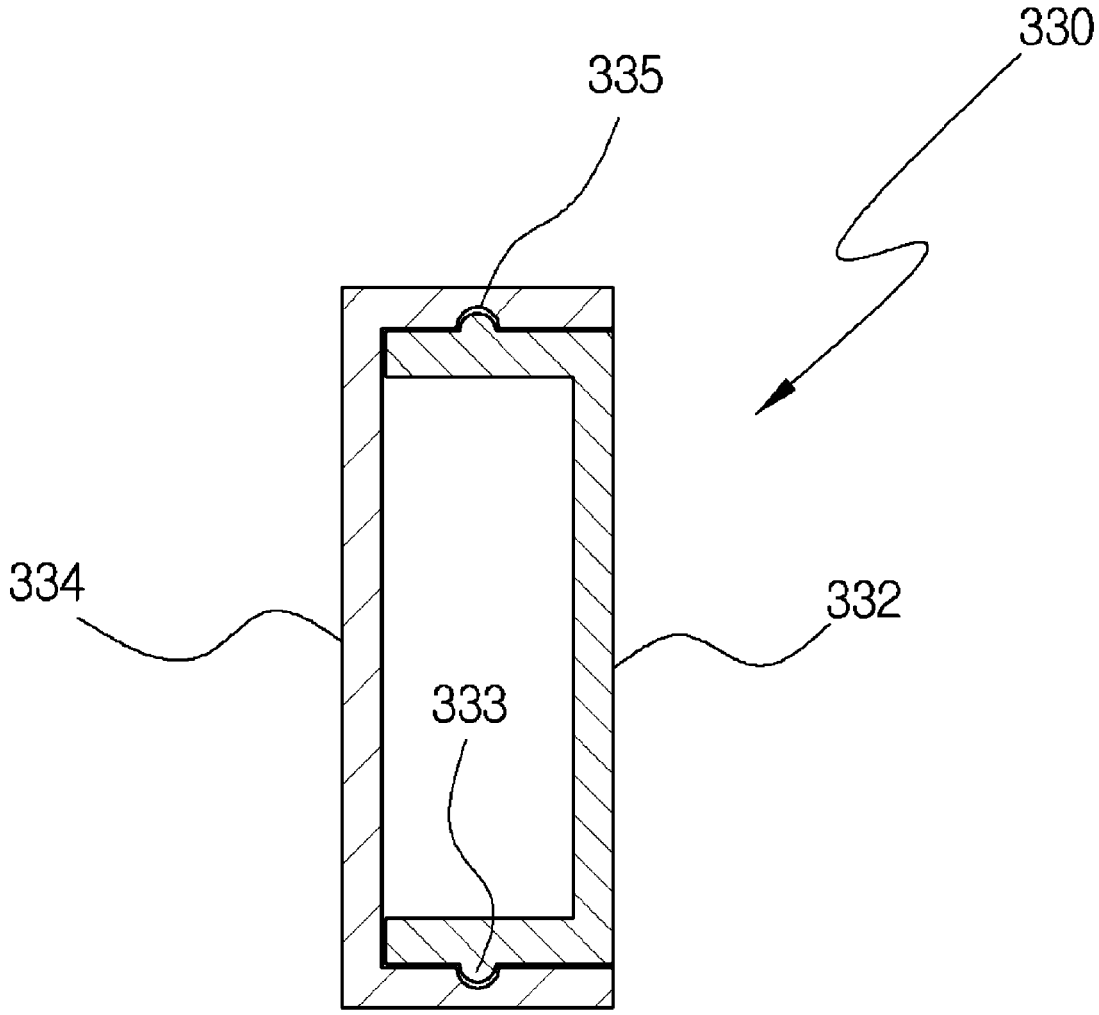
FIG. 23 is a top plan cross-sectional view illustrating another embodiment of a vertical rod of the security window according to the present invention.

FIG. 23 is a top plan cross-sectional view illustrating another embodiment of a vertical rod of the security window according to the present invention.

As shown in FIG. 23, the vertical rod 330 can be implemented in such a way that an internal member 332 and an external member 334, shaped as the Korean letter ' ' read as 'DiGeut', are coupled to each other. The internal member 332 is fitted into the inside of the external member 334. The internal member 332 forms a lengthwise protrusion 333 on outer surfaces of both side walls, respectively. The external member 334 forms a lengthwise groove 335 on inner surfaces of both side walls, corresponding to the lengthwise protrusion 333 of the internal member 332. Therefore, when the internal member 332 is inserted into the inside of the external member 334, the lengthwise protrusions 333 of the internal member 332 are fitted into the lengthwise grooves 335 of the external member 334. When the internal member 332 is coupled to the external member 334, the vertical rod 330 is formed shaped as a rectangular rod whose inside is hollow.

Although the upper guide rod and the lower guide rod, guiding the vertical rods, are implemented as a rod structure in an embodiment of the present invention, it should be understood that the present invention is not limited to the embodiment. For example, the guide rod can be implemented as various shapes only if it can guide the vertical rods and allow the entry of the hook movement control member at a particular position. An example of the guide rod may be a rail.

Since the security window is implemented to install the hook movement control member within the vertical rod, the hook movement control member cannot be cut from the outside. That is, the security window can prevent the hook movement control member from being cut from the outside.

The security window is coupled to the operable window sash and the other half of the window sash is fixed to the window frame so that it cannot be opened.

As described above, the security window according to the present invention can be collapsed or expanded simultaneously as the window sash is opened or closed, and is almost invisible when the window sash is closed, so that people cannot view it, which does not affect the appearance of the window.

The security window can be installed in various sizes of window frames by adjusting its size using its height control member, which provides cost-effective window security.

The security window can be protected against external attempts of cutting or damage via the hook movement control member installed into the vertical rod, where the hook movement control member is joined with the window sash.

Although exemplary embodiments of the present invention have been described in detail hereinabove, it should be understood that many variations and modifications of the basic inventive concept herein described, which may appear to those skilled in the art, will still fall within the spirit and scope of the exemplary embodiments of the present invention as defined in the appended claims.

What is claimed is:

1. A security window comprising:

a plurality of vertical rods vertically arranged in a window frame;

a plurality of links for connecting the plurality of vertical rods, variably spaced between the vertical rods;

a guide rod, coupled to at least part of the vertical rods and fixed to the window frame, for guiding the movement of the vertical rods;

a hook operating member vertically movably installed in a first vertical rod of the vertical rods, located farthest from one side of the vertical rods, the hook operating member having a hook;

a hook movement control member, installed within the first vertical rod, for being vertically moved according to the vertical movement of the hook operating member; and a hook receiving member fixed to a jamb of an operable window sash for forming a hollow space to which the hook enters, wherein a second vertical rod located farthest from the first vertical rod is fixed inside the window frame, and the guide rod forms a groove at a position close to one end portion thereof, where the hook movement control member enters the groove.

2. The security window according to claim 1, wherein:

the first vertical rod forms a space allowing the upward movement of the hook movement control member; and the guide rod is coupled to the first vertical rod to interrupt a particular position in a space allowing the upward movement of the hook movement control member of the first vertical rod, and the lift of the hook movement control member from the particular position is interrupted by a portion except for the groove of the guide rod.

3. The security window according to claim 1, wherein the hook operating member is fixed to one side of the hook movement control member.

4. The security window according to claim 1, wherein:

the guide rod forms a vertical body as its one end is bent, the vertical body forming a thread on its outer surface; and the security window further comprises a length adjustment internal screw member whose inner walls forms a thread corresponding to that of the vertical body, where the length adjustment internal screw member is rotatably coupled to the upper end of the vertical body.

5. A security window comprising:

a plurality of vertical rods vertically arranged to a window frame;

a plurality of links for connecting the plurality of vertical rods, variably spacing a distance between the vertical rods;

a hook operating member installed on a first vertical rod of the vertical rods to vertically move, located the farthest from one side of the vertical rods, the hook operating member having a hook;

a hook movement control member, installed within the first vertical rod, for being vertically moved according to the vertical movement of the hook operating member; and a hook receiving member fixed to a jamb of an operable window sash for forming a hollow space which the hook enters, wherein a second vertical rod located farthest from the first vertical rod is fixed to the inside of the window frame, and the window frame forms a groove on its lower surface of a head jamb close to a side jamb, and the groove allows the entry of the hook movement control member.

* * * * *